US010945524B2

(12) United States Patent
Choi

(10) Patent No.: US 10,945,524 B2
(45) Date of Patent: Mar. 16, 2021

(54) REFRIGERATOR

(71) Applicant: LG Electronics Inc., Seoul (KR)

(72) Inventor: Kwanghyun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/557,579

(22) Filed: Aug. 30, 2019

(65) Prior Publication Data

US 2020/0069055 A1 Mar. 5, 2020

(30) Foreign Application Priority Data

Aug. 31, 2018 (KR) ..... 10-2018-0103971

(51) Int. Cl.

| | |
|---|---|
| ***A47B 88/44*** | (2017.01) |
| ***F25D 25/02*** | (2006.01) |
| ***A47B 88/453*** | (2017.01) |
| ***A47B 88/90*** | (2017.01) |
| ***A47B 88/423*** | (2017.01) |
| ***A47B 88/437*** | (2017.01) |

(52) U.S. Cl.

CPC ..... *A47B 88/44* (2017.01); *A47B 88/423* (2017.01); *A47B 88/437* (2017.01); *A47B 88/453* (2017.01); *F25D 25/025* (2013.01); *A47B 2088/901* (2017.01); *A47B 2210/175* (2013.01)

(58) Field of Classification Search

CPC ..... F25D 25/025; F25D 23/028; F25D 23/04; F25D 11/02; F25D 2323/02; F25D 25/04; F25D 23/021; F25D 25/005; F25D 25/00

See application file for complete search history.

(56) References Cited

U.S. PATENT DOCUMENTS

| | | | | |
|---|---|---|---|---|
| 2,833,063 | A * | 5/1958 | Drummond | D06F 81/04 108/117 |
| 5,429,043 | A * | 7/1995 | Becker | F24C 15/16 126/337 A |
| 7,581,796 | B2 * | 9/2009 | Jeong | A47B 46/00 312/402 |
| 7,628,461 | B2 * | 12/2009 | Carden | F25D 25/025 312/310 |
| 7,810,891 | B2 * | 10/2010 | Lee | F25D 25/025 312/402 |
| 9,377,238 | B2 | 6/2016 | Hall et al. | |
| 10,234,195 | B2 * | 3/2019 | Yasaka | B66F 7/02 |

(Continued)

OTHER PUBLICATIONS

EP Search Report in European Application No. EP19194355, dated Jan. 8, 2020, 11 pages.

*Primary Examiner* — Hanh V Tran

(74) *Attorney, Agent, or Firm* — Fish & Richardson P.C.

(57) ABSTRACT

A refrigerator includes a cabinet defining a storage chamber, a drawer door, a rail assembly that slidably couples the drawer door to the cabinet, a driving device disposed at the door part, and an elevation device disposed at the drawer part to vertically elevate at least a portion of the drawer part. The driving device includes a motor assembly, a pair of screw units, and a pair of levers, each of the pair of levers being coupled to and configured to be rotated by a corresponding one of the pair of screw units to elevate the elevation device. The drawer door includes a door part configured to open and close the storage chamber and a drawer part that is configured to be inserted into and withdrawn out of the storage chamber and defines a storage space.

20 Claims, 26 Drawing Sheets

(56) References Cited

U.S. PATENT DOCUMENTS

| | | | | |
|---|---|---|---|---|
| 10,465,970 | B1 * | 11/2019 | Kang | F25D 23/062 |
| 10,598,425 | B2 * | 3/2020 | Choi | F25D 25/022 |
| 2006/0021373 | A1 * | 2/2006 | Oh | F25D 25/025 62/407 |
| 2006/0043849 | A1 * | 3/2006 | Oh | F25D 25/025 312/310 |
| 2006/0207283 | A1 * | 9/2006 | Kim | F25D 25/025 62/407 |
| 2008/0203041 | A1 * | 8/2008 | Lim | F25D 25/02 211/119.003 |
| 2014/0021847 | A1 * | 1/2014 | Wehner | A47B 96/00 312/405 |
| 2014/0265797 | A1 * | 9/2014 | Scheuring | A47B 51/00 312/404 |
| 2014/0265798 | A1 * | 9/2014 | Watts | F25D 23/04 312/404 |
| 2014/0265806 | A1 * | 9/2014 | Hall | F25D 25/025 312/408 |
| 2015/0076985 | A1 * | 3/2015 | Yoo | F25D 25/024 312/408 |
| 2019/0292831 | A1 * | 9/2019 | Choi | F25D 23/028 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0103971, filed on Aug. 31, 2018, which is hereby incorporated by reference in its entirety.

TECHNICAL FIELD

The present disclosure relates to a refrigerator.

BACKGROUND

In general, refrigerators are home appliances for storing foods at a low temperature in a storage chamber that is covered by a door. Generally, refrigerators cool the inside of the storage chamber by using cool air generated by being heat-exchanged with a refrigerant circulated through a refrigeration cycle to store foods in an optimum state.

In recent years, refrigerators have become increasingly multi-functional with changes of dietary lives and diversification of products, and, accordingly, refrigerators having various structures and convenience devices for convenience of users and for efficient use of internal spaces have been released.

The storage chamber of the refrigerator may be opened/closed by the door. Also, refrigerators may be classified into various types according to an arranged configuration of the storage chamber and a structure of the door for opening and closing the storage chamber.

The refrigerator door may be classified into a rotation-type door that opens and closes a storage chamber through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to bend his/her back to take out a basket or foods in the drawer-type door. If the basket or the foods are heavy, the user may find it inconvenient to use the basket and/or may be injured.

SUMMARY

According to one aspect of the subject matter described in this application, a refrigerator includes a cabinet that defines a storage chamber, a drawer door including a door part configured to open and close the storage chamber and a drawer part that is configured to be inserted into and withdrawn out of the storage chamber and defines a storage space, a rail assembly that slidably couples the drawer door to the cabinet, a driving device disposed at the door part and configured to provide a driving force, and an elevation device disposed at the drawer part, the elevation device being coupled to the driving device to vertically elevate at least a portion of the drawer part. The driving device includes a motor assembly, a pair of screw units, each of the pair of screw units being disposed on opposite sides of the motor assembly and configured to be actuated by the motor assembly at the same time as each other, and a pair of levers, each of the pair of levers being coupled to and configured to be rotated by a corresponding one of the pair of screw units, the pair of levers being coupled to and configured to elevate the elevation device. Each of the screw units includes a housing, a screw disposed in the housing and configured to be rotated by the motor assembly, a screw holder that receives the screw, the screw having a screw thread corresponding to the screw to thereby move along the screw based on a rotation of the screw, and a guide bar disposed parallel to the screw inside the housing, the guide bar passing through the screw holder to thereby guide the movement of the screw.

Implementations according to this aspect may include one or more of the following features. For example, the guide bar may include a pair of guide bars disposed on opposite sides of the screw. The guide bar may be made of a metal material. The screw holder may define a guide hole through which the guide bar passes. The screw holder may include a lubrication portion at an inner surface of the guide hole that contacts the guide bar. The driving device may include a cover portion that covers the motor assembly and the housings of the pair of screw units.

In some implementations, the pair of screw units may be oriented symmetrical to each other with respect to the motor assembly, and a distance between the pair of screw units may increase toward an upper side of the motor assembly. In some cases, the motor assembly may include a motor disposed at the upper side of the motor assembly and a plurality of gears rotatably connected to a rotation shaft of the motor. The plurality of gears may be arranged in a vertical direction toward a lower side of the pair of screw units. In some cases, a rotation shaft of the screw and the rotation shaft of the motor may be transverse to each other. A vertically lowermost one of the plurality of gears may be connected to a lower end of the screw through a helical gear coupling. In some cases, the plurality of gears may include a driving gear fixed to the rotation shaft of the motor, an intersection gear rotatably coupled to the screw, and one or more transmission gears that rotatably couple the driving gear to the intersection gear. Here, the intersection gear may include a spur gear part having a spur gear shape and coupled to one of the one or more transmission gears, and a first helical gear part that is coupled to a second helical gear part disposed on the lower end of the screw.

In some implementations, the door part may include an outer plate that defines an outer appearance of the drawer door, a door liner that is spaced apart from the outer plate and defines a rear surface of the door part, and an insulation material disposed between the outer plate and the door liner. Here, the door liner may define a recess part in which the driving device is accommodated. The door part may further include a door cover that is disposed on the rear surface of the door part and that covers the driving device. The drawer part may be mounted on the door part, and a front surface of the drawer part may cover the driving device.

In some implementations, an accommodation part is provided in a rotation shaft of the lever, and a coupling part that is detachably coupled to the accommodation part may be disposed on the elevation device. In some cases, the refrigerator may further include a door cover disposed on a rear surface of the door part and configured to cover the driving device, a cover opening may be defined in the door cover at a position corresponding to the accommodation part, and a drawer opening may be defined in a front surface of the drawer part at a position corresponding to the coupling part. The driving device may include one or more hall sensors that are configured to sense a position of the screw holder along the screw, the screw holder including a magnet that is configured to be sensed by the one or more hall sensors.

According to another aspect, a refrigerator includes a cabinet that defines a storage chamber, a drawer door including a door part configured to open and close the storage chamber and a drawer part that is configured to be inserted into and withdrawn out of the storage chamber and defines a storage space, a rail assembly that slidably couples the drawer door to the cabinet, a driving device disposed at the door part and configured to provide a driving force, and an elevation device disposed at the drawer part, the elevation device being coupled to the driving device to vertically elevate at least a portion of the drawer part. The driving device includes a motor assembly having a motor and a plurality of gears configured to be rotated by the motor, each of the plurality of gears being configured to rotate about respective gear axes that are parallel to a rotation shaft of the motor, a pair of screw units, each of the pair of screw units being disposed on opposite sides of the motor assembly and configured to be actuated by the motor assembly at the same time as each other, and a pair of levers, each of the pair of levers being coupled to and configured to be rotated by a corresponding one of the pair of screw units, the pair of levers being coupled to and configured to elevate the elevation device. Each of the screw units includes a screw configured to be rotated by the motor assembly along a screw axis that is transverse to the gear axes, and a screw holder that receives the screw, the screw having a screw thread corresponding to the screw to thereby move along the screw based on a rotation of the screw. The plurality of gears of the motor assembly includes a pair of intersection gears that are orthogonally coupled to respective lower ends of the screws to thereby transmit a driving torque of the motor to the pair of screw units.

Implementations according to this aspect may include one or more of the following features. For example, the pair of intersection gears may include helical gears that are orthogonally coupled to corresponding helical gears that drive the screws. The driving device may include one or more hall sensors that are configured to sense a position of the screw holder along the screw, the screw holder including a magnet that is configured to be sensed by the one or more hall sensors.

The details of one or more implementations are set forth in the accompanying drawings and the description below. Other features will be apparent from the description and drawings, and from the claims.

DETAILED DESCRIPTION

Hereinafter, implementations of the present disclosure will be described in detail with reference to the accompanying drawings.

Figure 1:
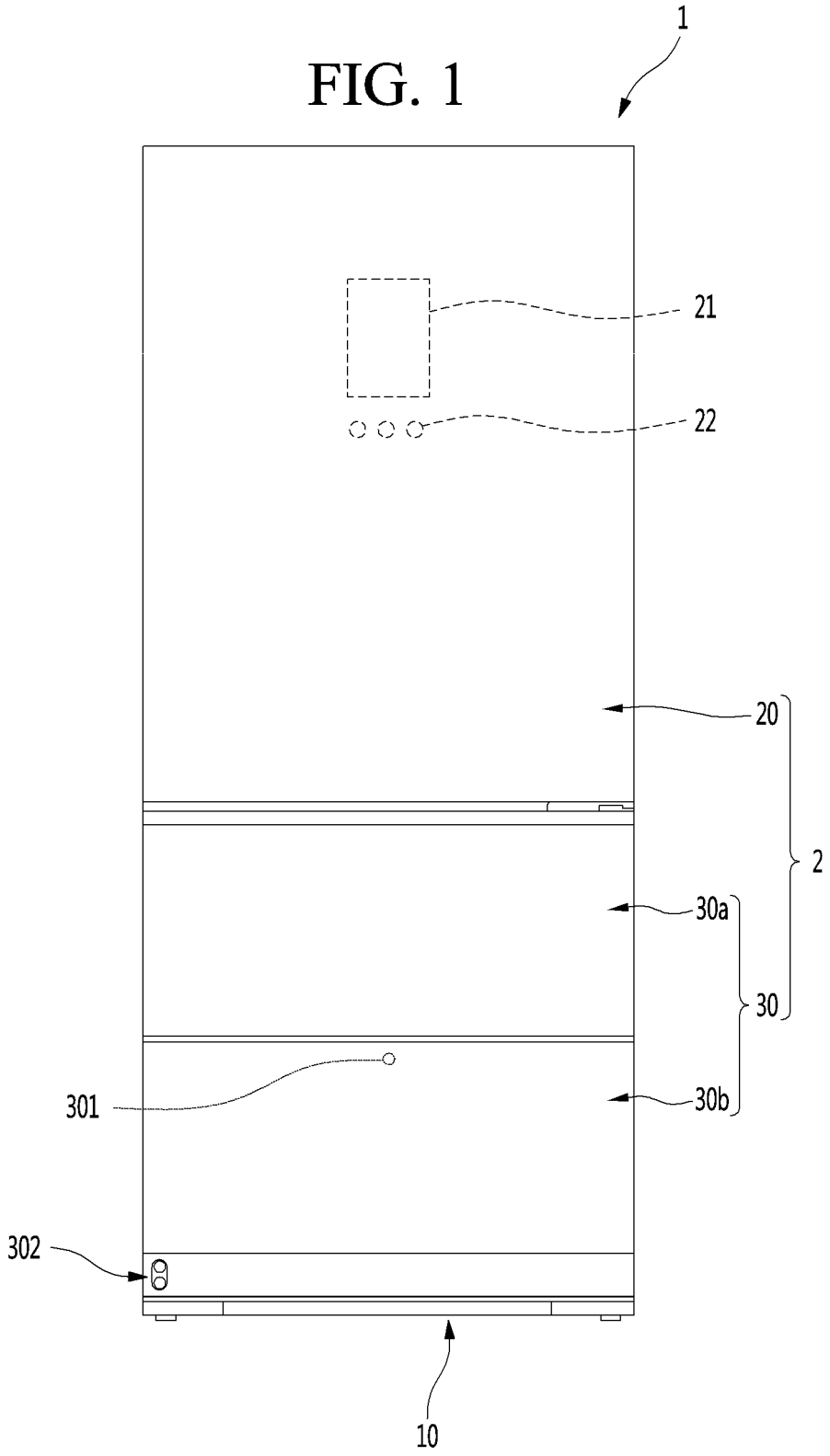
FIG. 1 is a front view of a refrigerator according to an implementation.

FIG. 1 is a front view of a refrigerator according to an implementation. Also, FIG. 2 is a schematic view illustrating an elevation state of a lower drawer door of the refrigerator according to an implementation.

Figure 2:
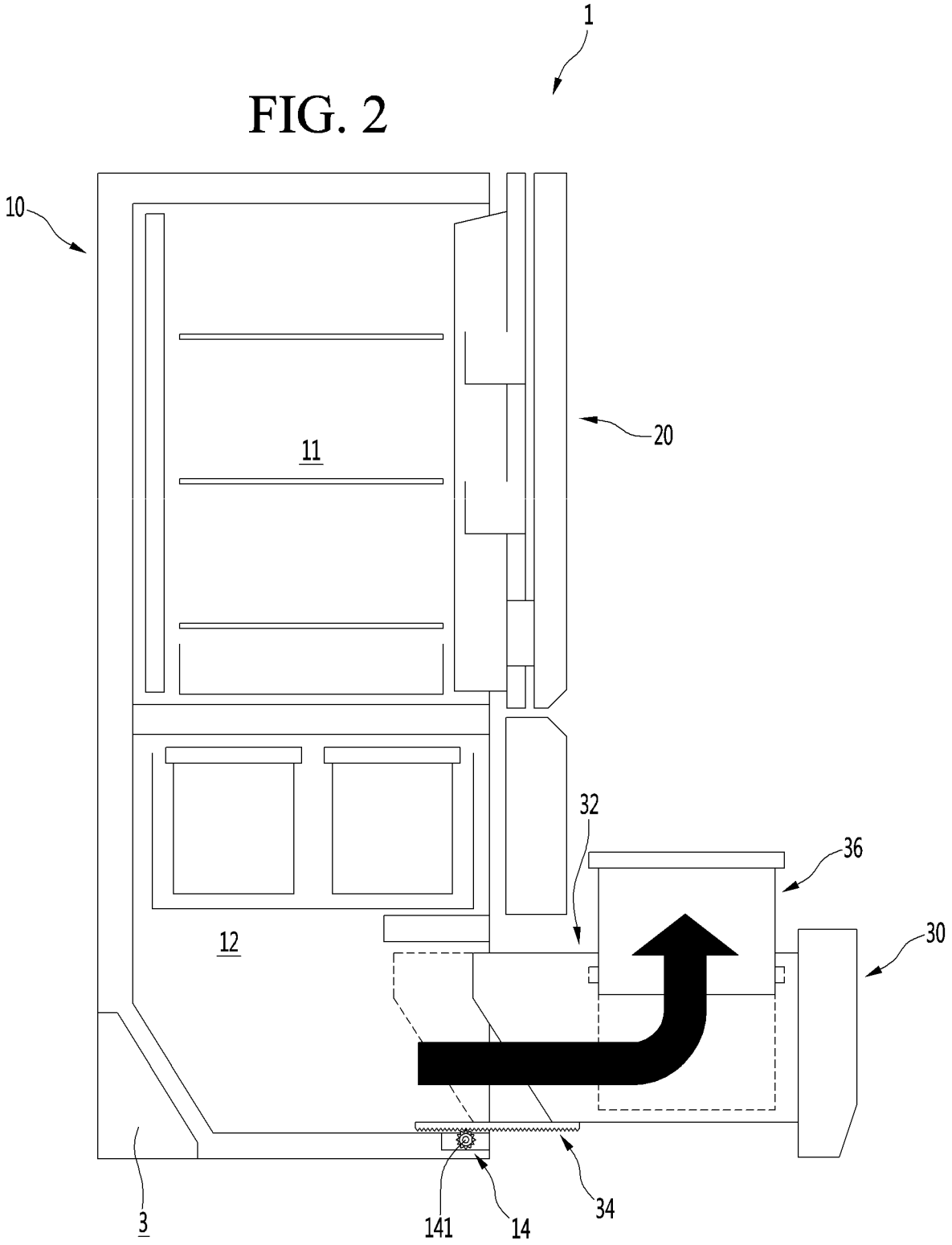
FIG. 2 is a schematic view illustrating an elevation state of a lower drawer door of the refrigerator according to an implementation.

Referring to FIGS. 1 and 2, a refrigerator 1 may have an outer appearance that is defined by a cabinet 10 defining a storage chamber and a door 2 covering an opened front surface of the cabinet 10.

The storage chamber of the cabinet 10 may be divided into a plurality of spaces. For example, an upper space 11 of the cabinet 10 may be provided as a refrigerating compartment, and a lower space, or lower storage chamber, 12 may be provided as a freezing compartment. Each of the upper space and the lower space may be provided as an independent space that is maintained at a different temperature, except for the refrigerating compartment and the freezing compartment. The upper space and the lower space may be called an upper space and a lower space.

The door 2 may include a rotation door 20 opening and closing the upper space through rotation thereof and a drawer door 30 opening and closing the lower space by being inserted or withdrawn in a drawer manner. The lower space may be vertically divided again. The drawer door 30 may include an upper drawer door 30*a* and a lower drawer door 30*b*.

Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. The display 21 may have a liquid crystal display structure or a 88 segment structure.

Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20.

The manipulation part 22 may be integrated with the display 21 and may operate in a touch manner or a button manner. The manipulation part 22 may input a command with respect to an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the lower drawer door 30*b*, which is disposed at the lowermost portion, of the drawer door 30. The manipulation part 301 may operate in a touch or button manner. The manipulation part 301 may be provided as a sensor detecting proximity or movement of a user or provided as an input unit that operates by a user's motion or voice.

In some implementations, a manipulation device 302 may be disposed on a lower end of the lower drawer door 30*b* to illuminate an image on a bottom surface and thereby to output a virtual switch and to input an operation when the user approaches a corresponding area.

The lower drawer door 30*b* may be automatically inserted and withdrawn according to the manipulation of the manipulation part 301. Also, a food or container within the lower drawer door 30*b* may be elevated in a state in which the lower drawer door 30 is withdrawn by the manipulation of the manipulation part 301.

That is, the automatic insertion and withdrawal and/or automatic elevation of the lower drawer door 30*b* may be performed by at least one of a plurality of manipulation devices 22, 301, 302, and 303. One or more of the plurality of manipulation devices 22, 301, 302, and 303 may be provided as needed.

The manipulation devices 22, 301, 302, and 303 may be used to insert/withdraw and elevate the drawer door 30. Also, the insertion/withdrawal and the elevation may be performed by a combination or sequential operation of the plurality of manipulation devices 22, 301, 302, and 303.

To allow access to the foods accommodated in the lower drawer door 30*b*, the lower drawer door 30*b* may be withdrawn forward to allow the container 36 within the lower drawer door 30*b* to be elevated.

The container 36 may have a predetermined height. Since the container 36 is seated on the elevation device 80, which will be described later, the height of the container 36 may increase by the height of the elevation device 80 when the elevation device 80 is elevated. Thus, when the elevation device 80 ascends, the container 36 may be disposed at a point at which the user is able to easily access the container 36 and also more easily lift the container 36.

The container 326 may be completely accommodated in the accommodation part 32 when the lower drawer door 30*b* is inserted and withdrawn. When the elevation device ascends, the container 36 may be disposed at a higher position than the lower storage chamber 12.

Although the shape of the container 36 is not limited, the container 36 may have a shape corresponding to the size of a front space (see reference symbol S1 of FIG. 3) and may have a predetermined height to prevent the stored food from spilling out when the elevation device 80 ascends.

The food or container 36 inside the drawer door 30 disposed at the lowest position may be more easily lifted and used through the above-described manipulation.

The lower drawer door 30*b* may be automatically inserted and withdrawn forward and backward by the draw-out motor 14, the pinion 141 provided in the cabinet 10, and the draw-out rack 34 provided on the bottom surface of the lower drawer door 30*b*.

Also, the container inside the lower drawer door 30*b* may be elevated by the driving device 40 and the elevation device 80 provided in the lower drawer door 30*b*.

Hereinafter, the lower drawer door 30*b* and an operation of the lower drawer door 30*b* will be described in more detail. The lower drawer door 30*b* will be referred to as a drawer door or a door unless otherwise specified.

The implementations are not limited to the number and shape of the drawer doors and may be applied to all refrigerators having a door that is inserted and withdrawn in a drawer type into/from the lower storage chamber.

Figure 3:
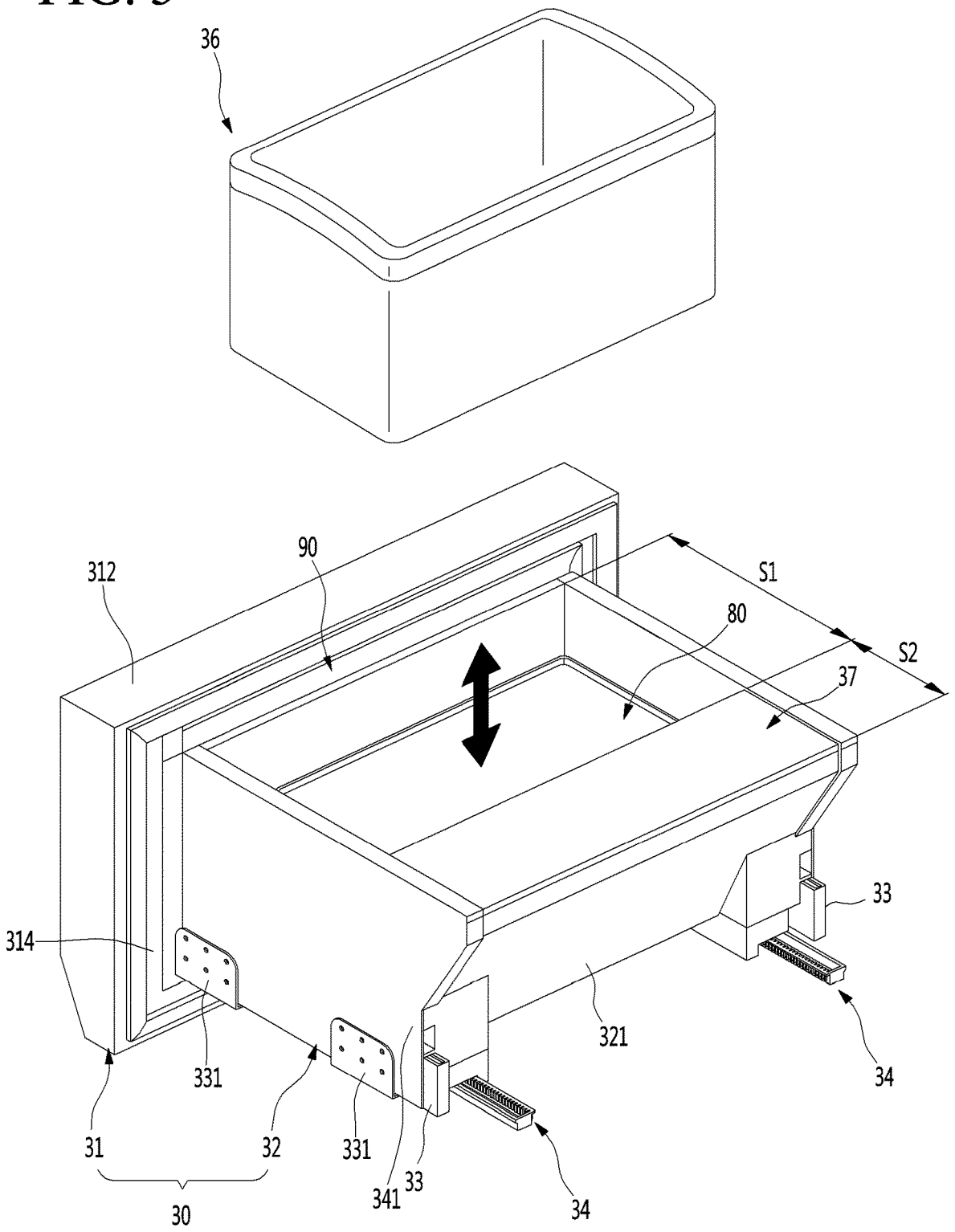
FIG. 3 is a perspective view illustrating a state in which a container of the lower drawer door is separated.
Figure 4:
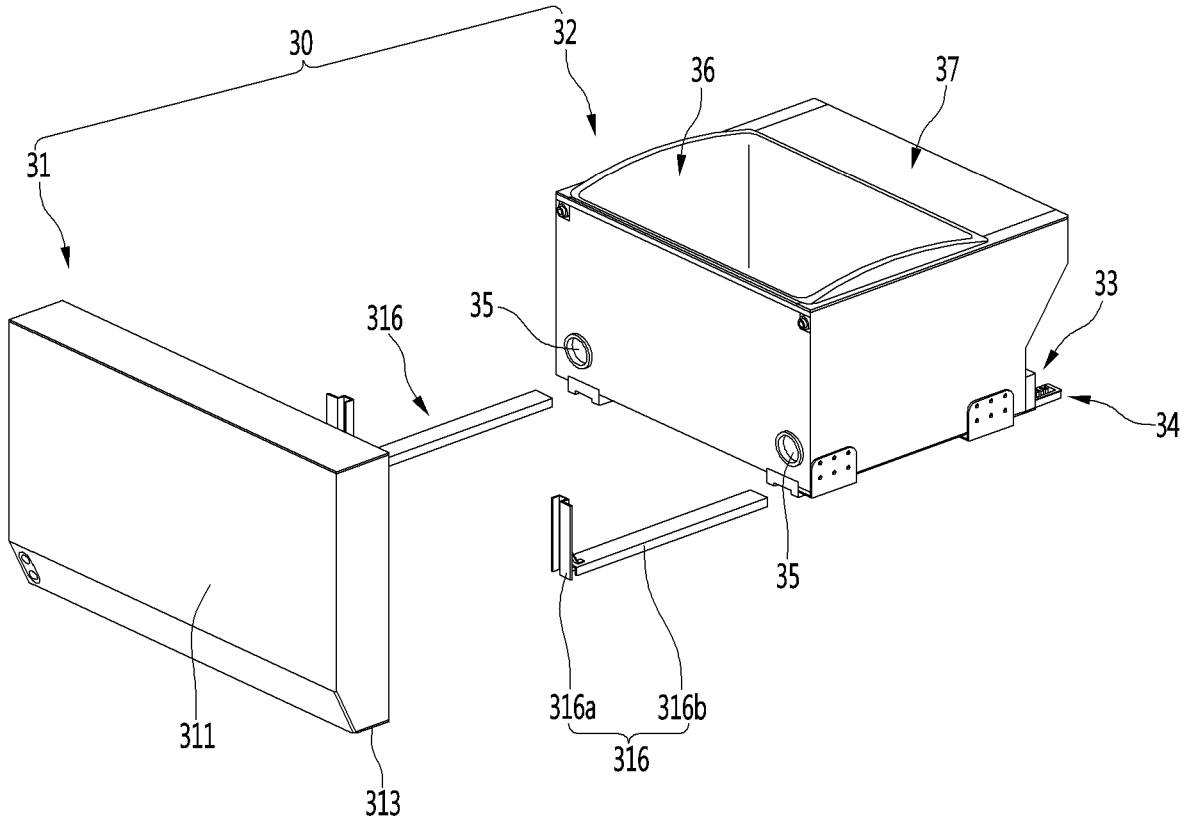
FIG. 4 is an exploded perspective view illustrating a state in which a drawer part of the lower drawer door and a door part are separated from each other when viewed from a front side.

FIG. 3 is a perspective view illustrating a state in which a container of the lower drawer door is separated. Also, FIG. 4 is an exploded perspective view illustrating a state in which the drawer part of the lower drawer door and the door part are separated from each other when viewed from a front side.

Referring to FIGS. 1 to 4, the door 30 may include a door part 31 opening and closing the storage chamber and a drawer part 32 coupled to a rear surface of the door part 31 and inserted and withdrawn together with the door part 31.

The door part 31 may be exposed to the outside of the cabinet 10 to define an outer appearance of the refrigerator 1, and the drawer part 32 may be disposed inside the cabinet 10 to define an storage chamber. Also, the door part 31 and the drawer part 32 may be coupled to each other and be inserted and withdrawn in a forward/backward direction together with each other.

The drawer part 32 may be disposed on the rear surface of the door part 31 to define a space in which the food or container to be stored is accommodated. The inside of the drawer part 32 may provide an upwardly opened storage chamber, and an outer appearance of the drawer part 32 may be defined by a plurality of plates (see reference numerals 391, 392, and 395 in FIG. 13).

Each of the plurality of plates 391, 392, and 395 may be made of a metal material and provided inside and outside the drawer part 32 so that the entire drawer part 32 is made of stainless steel or a material having a texture such as stainless steel.

In the state in which the door 30 is inserted, a machine room 3, in which a compressor and a condenser for performing a refrigeration cycle are provided, may be disposed behind the door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the door 30 may be provided on each of both side surfaces of the drawer part 32. The door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

A rail bracket 331 may be provided in the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, and thus the door 30, may be mounted to the cabinet 10 by the draw-out rails 33.

Also, the draw-out rail 33 may be disposed on a lower end of each of both surfaces of the drawer part 32. Also, lower ends of both side surfaces of the drawer part 32 may be mounted to be seated from an upper side of the draw-out rail 33. Thus, the draw-out rail 33 may be referred to as an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the door 30. That is, when an operation is inputted into the manipulation parts 22 and 301, the draw-out motor 14 may be driven to insert and withdraw the door 30 according to movement of the draw-out rack 34. Here, the door 30 may be stably inserted and withdrawn by the draw-out rail 33.

The draw-out rack 34 may not be provided on the drawer part 32. Here, the user may hold a side of the door part 31 to push and pull the door part 31 so that the door 30 is directly inserted and withdrawn.

The inside of the drawer part 32 may be divided into a front space S1 and a rear space S2. The elevation device 80 that is vertically elevated and a container seated on the elevation device 80 to be elevated together with the elevation device 80 may be disposed in the front space S1.

Although the container 36 is illustrated in the form of a basket having an opened upper portion, the container 36 may have a closed box structure such as a kimchi box. Also, a plurality of containers 36 may be stacked or arranged in parallel to each other.

In some implementations, when the door 30 is withdrawn, the entire drawer part 32 may not be withdrawn to the outside of the storage chamber due to a limitation in draw-out distance of the door 30. In such cases, at least the front space S1 is withdrawn to the outside of the storage chamber, and the whole or a portion of the rear space S2 remains disposed inside the storage chamber within the cabinet 10.

In such a structure, a draw-out distance of the door 30 may be limited by the draw-out rack 34 or the draw-out rail 33. As the draw-out distance becomes longer, the moment applied to the door 30 may become larger in the drawn-out state, and thus it may be difficult to maintain a stable state, thus resulting in possible deformation or damage of the draw-out rail 33 or the draw-out rack 34 may occur.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, elements of the elevation device 80 may not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

The drawer cover 37 may be mounted to cover the rear space S2 when the door 30 is withdrawn. In the state in which the door 30 is withdrawn, only the front space S1 may be exposed to provide more clean outer appearance. Also, a remaining space except for the space in which the elevation device 80 and the container 36 are mounted may be covered to prevent the foods from dropping or becoming jammed in a gap during the elevation process.

However, when the drawer cover 37 is separated, the user may access the rear space S2, and thus, foods may be easily accommodated in the rear space S2. To utilize the rear space S2, a separate pocket or a container corresponding to the shape of the rear space may be disposed in the rear space S2.

In some cases, the elevation device 80 inside the drawer part 32 may be simply separated and mounted to utilize the entire space inside the drawer part 32, and the elevation device 80 and the drawer cover 37 may be separated from each other to utilize the entire space of the drawer part 32.

The outer appearance of each of the inner and outer surfaces of the drawer part 32 may be defined by the plates (see reference numerals 391, 392 and 395 of FIG. 12), which cover the components mounted on the drawer part 32, and thus, the outer and inner appearances may be seen to be neat. The plates (see reference numerals 391, 392, and 395 of FIG. 12) may include a plurality of plates and may be made of stainless steel to provide a more luxurious and clean appearance.

As illustrated in the drawings, the door part 31 and the drawer part 32 of the door 30 may be separably coupled to each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation device 80 may be provided.

The driving device (see reference numeral 40 of FIG. 6) for elevating the elevation device 80 may be disposed on the door part 31, and the door part 31 and the drawer part 32 may be selectively connected to each other.

In more detail, the driving part (see reference numeral 40 of FIG. 6) provided in the door part 31 may be configured to receive power from the power source and to transmit the power to the elevation part 80. Thus, it may be possible to remove the door part 31 when the service of the driving part (see reference numeral 40 of FIG. 6) is necessary and to, if necessary, simply replace just the door part 31.

The door part 31 and the drawer part 32 may be coupled by a pair of door frames 316 provided on both sides.

The door frame 316 may include a door coupling part 316*a* extending upward and downward to be coupled to the door part and a drawer coupling part 316*b* extending backward from a lower end of the door coupling portion 316*a*.

The door coupling part 316*a* may be coupled to the door part 31 by a separate coupling member and may be coupled to one side of the door part 31 by a simple coupling structure. Also, the drawer coupling part 316*b* may be disposed to be inserted into both sides of the drawer part 32 so as to be adjacent to the draw-out rail 33. Also, the drawer coupling part 316*b* may be mounted on the drawer part 32 in the state of being coupled to the draw-out rail 33.

The drawer coupling part 316*b* may be inserted into the drawer part 32 to support the drawer part 32 in a state in which the door coupling part 316*a* is coupled to the door part 31. Also, the drawer coupling part 316*b* may be coupled to the drawer part 32 by a separate coupling member or may be coupled by a structure that mutually match the drawer coupling part 316*b*.

Also, a drawer opening 35 through which a portion of the elevation device 80 is exposed may be defined in the front surface of the drawer part 32 so that the driving device 40 and the elevation device 80 are connected to each other when the door part 31 and the drawer part 32 are coupled to each other.

The door part 31 may be configured to substantially open and close the storage chamber of the cabinet 10 and to define the front surface of the refrigerator 1.

The door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material 300 may be filled in the inside of the door part 31 between an outer case 311 and a door liner 314.

Hereinafter, the door part 31 of the door 30 and the driving device 40 provided in the door part 31 will be described in more detail with reference to the drawings.

Figure 5:
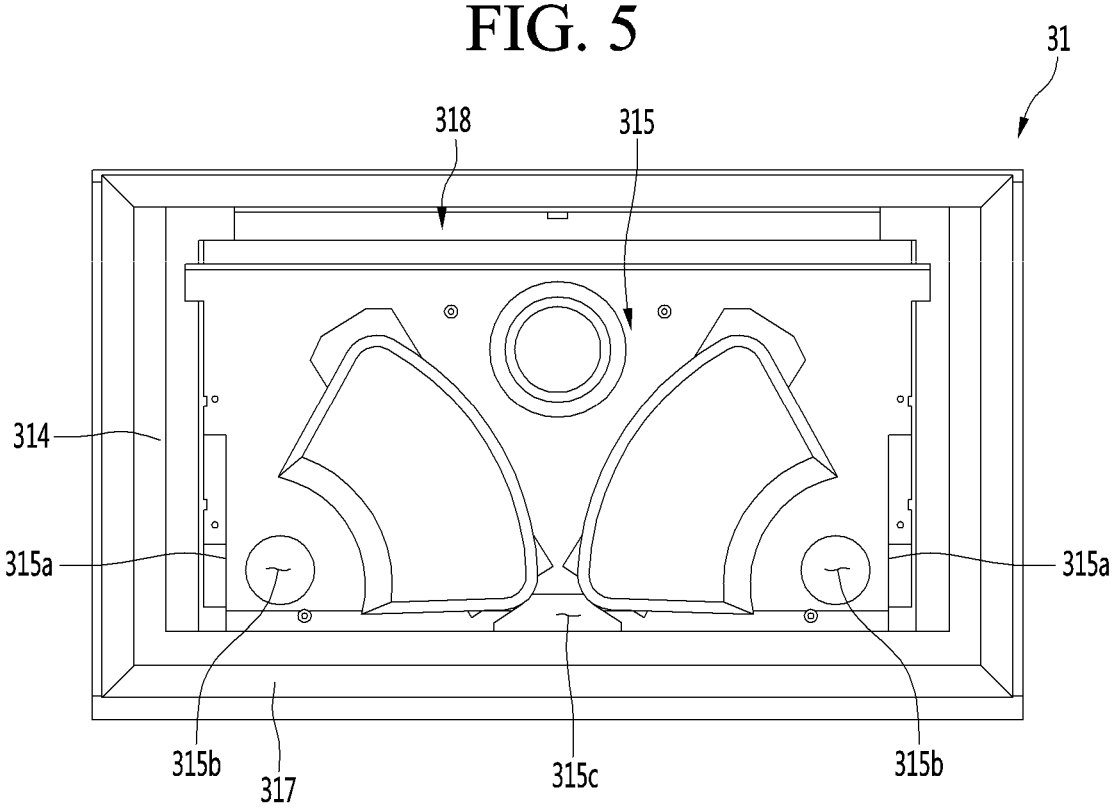
FIG. 5 is a rear view of the door part.
Figure 6:
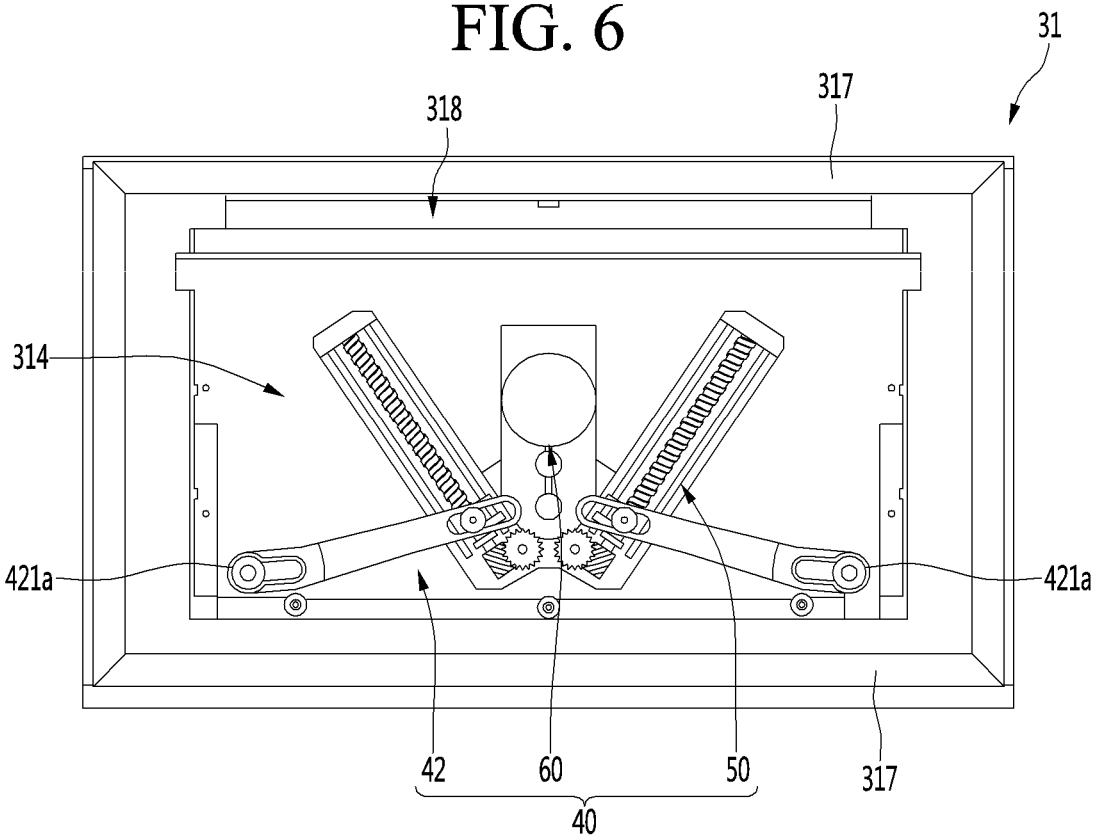
FIG. 6 is a rear view illustrating a state in which a door cover of the door part is removed.
Figure 7:
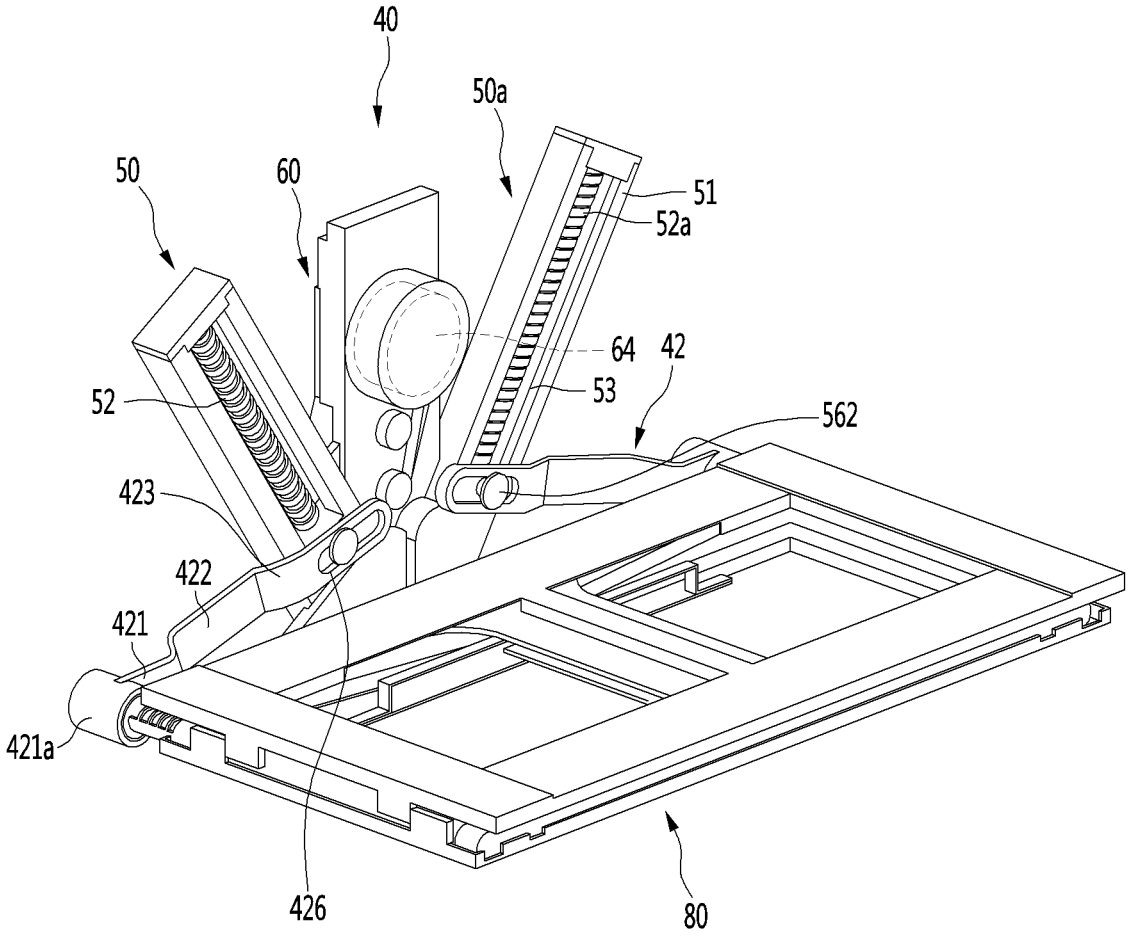
FIG. 7 is a perspective view illustrating a state in which a driving device and an elevation device are connected to each other when viewed from a front side of the driving device.
Figure 8:
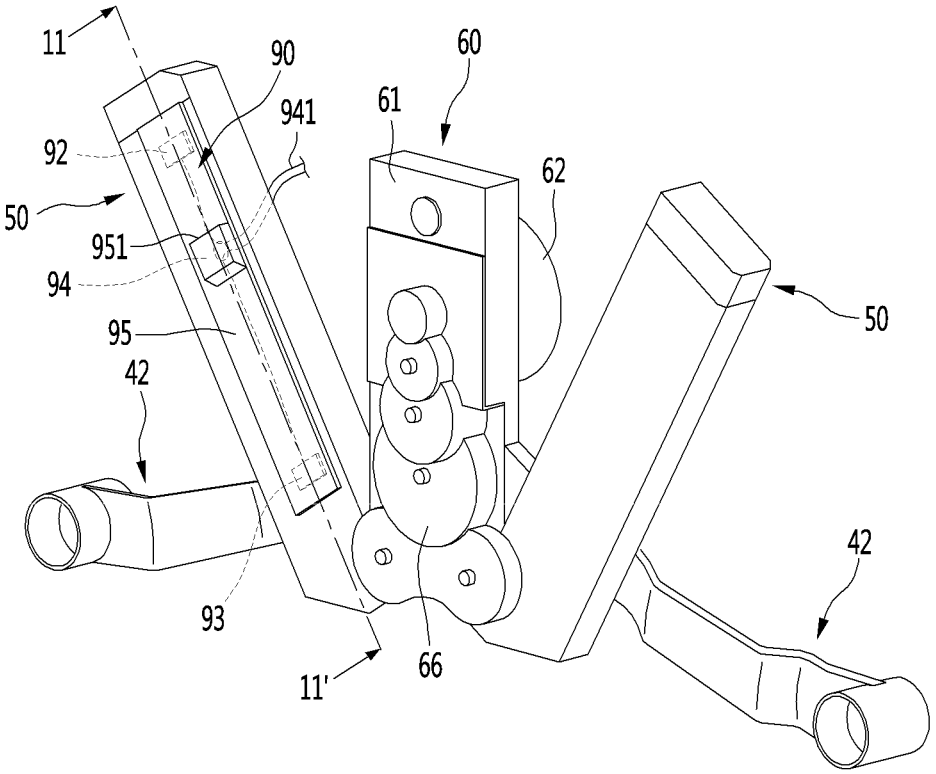
FIG. 8 is a rear perspective view of the driving device.
Figure 9:
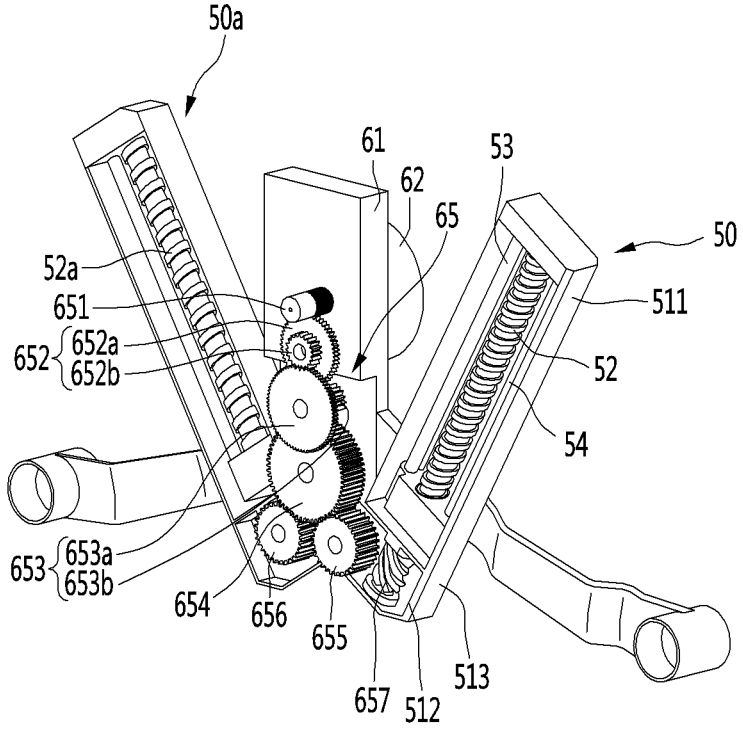
FIG. 9 is a rear perspective view illustrating an internal structure of the driving device.
Figure 10:
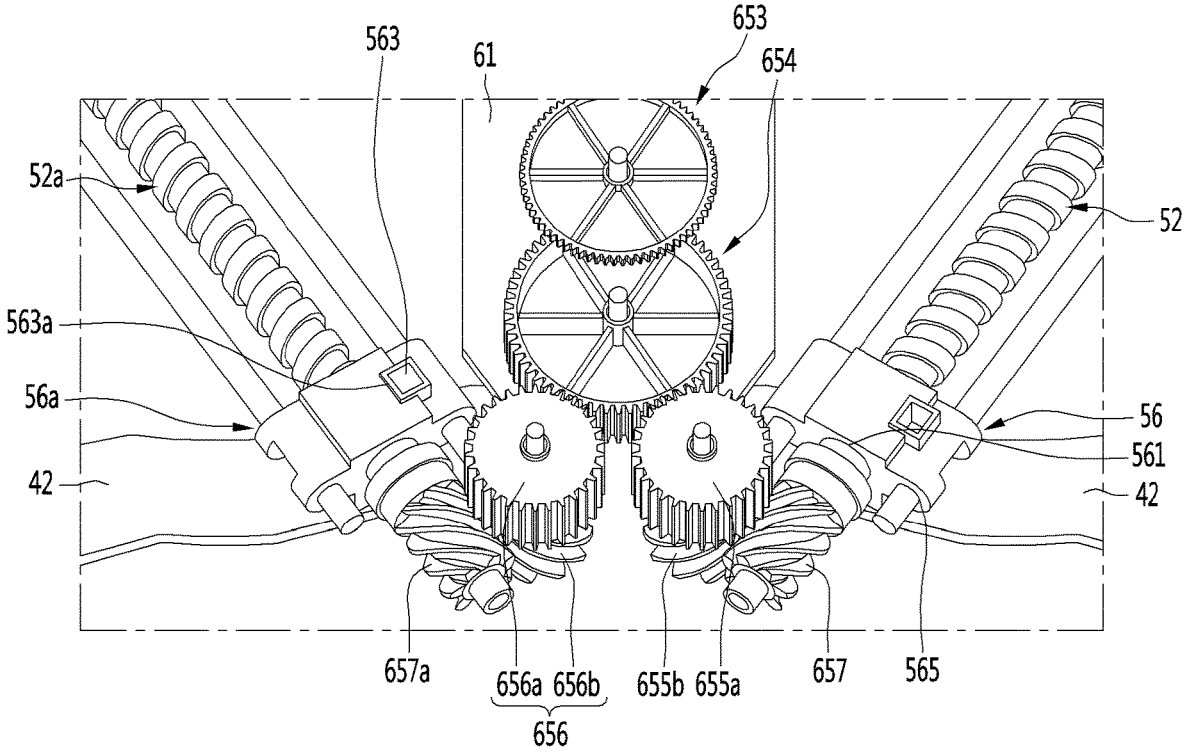
FIG. 10 is a partial enlarged view of a structure in which power is transmitted to a screw of the driving device.
Figure 11:
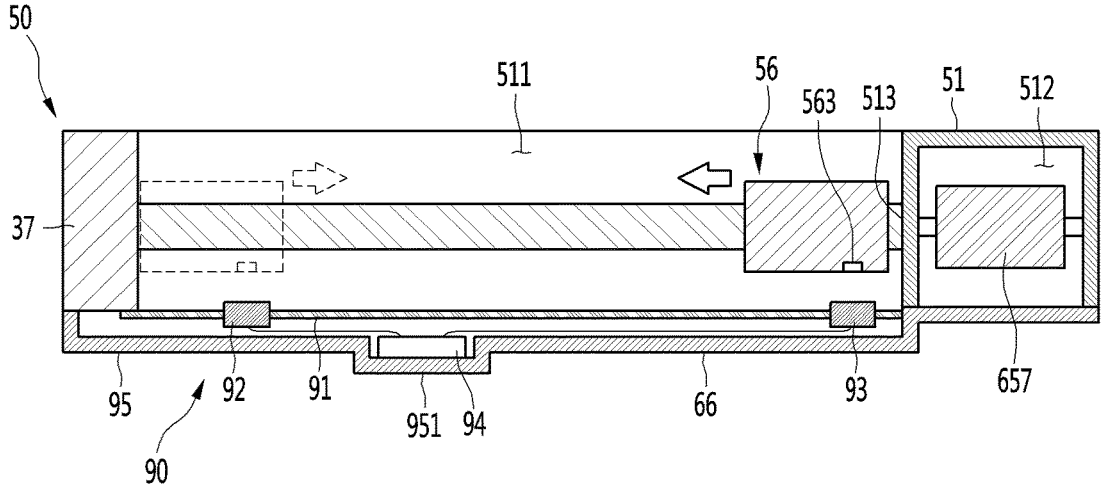
FIG. 11 is a cross-sectional view taken along line 11-11' of FIG. 8.

FIG. 5 is a rear view of the door part. Also, FIG. 6 is a rear view illustrating a state in which a door cover of the door part is removed. Also, FIG. 7 is a perspective view illustrating a state in which the driving device and the elevation device are connected to each other when viewed from a front side of the driving device. Also, FIG. 8 is a rear perspective view of the driving device. Also, FIG. 9 is a rear perspective view illustrating an internal structure of the driving device. Also, FIG. 10 is a partial enlarged view of a structure in which power is transmitted to a screw of the driving device. Also, FIG. 11 is a cross-sectional view taken along line 11-11' of FIG. 8.

Referring to FIGS. 4 to 11, a front surface of the door part 31 may be defined by the outer plate 311, and a rear surface may be defined by the door liner 314.

A driving device 40 for operating the elevation device 80 may be provided inside the door part 31. Although the driving device 40 may be disposed inside the door part 31, the driving device 40 may not be embedded in the insulation material. Rather, the driving device 40 may be disposed in a space defined by the door liner 314. Then, the driving device 40 may be covered by the door cover 315 so as to not be exposed to the outside.

In some cases, the insulating material may be filled between the outer plate 311 and the door liner 314 to insulate the inside of the storage chamber 12.

In some cases, the door liner 314 may have a door recess part that is recessed inward. The door recess part may be defined to have a shape corresponding to the shape of the driving device 40 and may be recessed inside the door 30. Also, the door recess part may be recessed so that electric components including the lighting unit 318 for illuminating the inside of the refrigerator can be further mounted therein.

The lighting unit 318 may be elongated in the lateral direction from the left side to the right side of the rear surface of the door 30 and may be disposed at the uppermost position of the inner side regions of a gaskets 317 disposed along the rear surface of the door 30.

The lighting unit 318 may be configured so that light emitted from the plurality of LEDs is emitted to the inside of the door 30, particularly, the inside of the drawer part 32. When the door 30 is withdrawn to be opened, the lighting unit 318 may illuminate the inside of the drawer part 32.

The door cover 315 may be configured to define an outer appearance of the rear surface of the door part 31 and may cover the driving device 40 mounted on the door part 31. The door cover 315 may have a plate shape to cover the driving device so that the door cover 315 is not exposed in the driving device 40 is mounted.

The door cover 315 may have the cover recess part at a corresponding position to cover the driving device 40 from the rear side. The cover recess part may be recessed from the front surface of the door cover 315, i.e., the driving device 40, and the rear surface of the door cover 315 may protrude toward the inside of the storage chamber.

Also, a side cutout part 315*a* may be defined in the left and right ends of the door cover 315. The side cutout part 315*a* may be a portion that exposes the supporter 319 to be coupled with the door frame 316 and may be defined inward in a shape corresponding to the supporter 319.

Also, a door opening 315*b* may be defined in each of both sides of a lower end of the door cover 315. An accommodation part 421*a* of the lever 42, which is one component of the driving device 40, may be exposed through the cover opening 315*b*. Thus, the user may access the accommodation part 421*a* through the cover opening 315*b*. Also, the cover opening 315*b* may be disposed to face the drawer opening 35.

Thus, when the door par 31 and the drawer part 32 are coupled to each other, the cover opening 315*b* and the drawer opening (see reference numeral 35 of FIG. 13) may communicate with each other. Thus, the accommodation part 421*a* and the coupling part 842*c* of the elevation device 80 may be coupled to each other through the cover opening 315*b* and the drawer opening 35. That is, the driving device 40 and the elevation device 80 may be connected to each other, and the elevation device 80 may be elevated according to an operation of the driving device 40. Also, only the elevation device 80 may be separated by separating the accommodation part 421*a* from the coupling part 842*c* in the state in which the door part 31 and the drawer part 32 are coupled to each other.

A cable hole 315*c* may be further defined in the lower end of the door cover 315 to allow the cable to be connected to the electric components such as the driving device 40 and the lighting unit 318, which are provided in the door part 31. The electric wire that is accessible through the cable hole 315*c* may be connected to the cabinet 10 via the lower side of the drawer part 32.

The door gasket 317 may be provided along the rear surface of the door part 31. When the door 30 is closed, the door gasket 317 may contact, in an airtight manner, the front surface of the cabinet 10 in the state in which the door 30 is closed.

The driving part 40 may be disposed inside the door part 31 by being covered by the door cover 315. The power of the driving device 40 may be transmitted to the elevation device 80. Here, the power may be transmitted to both sides of the elevation device 80 so that the elevation device 80 ascends and descends in the horizontal state at both left and right sides without being tilted or biased to one side under any situation.

Hereinafter, an example structure of the driving device 40 will be described in more detail.

The driving device 40 may include a motor assembly 60, a pair of screw units 50 and 50*a* disposed on both sides of the motor assembly 60, and a pair of levers 42 respectively connected to the pair of screw units 50 and 50*a*.

In one implementation, the motor assembly 60 may be disposed at a central portion along a left-right direction of the door part 31. The driving device 40 may actuate both of the screw units 50 and 50*a* and the levers 42 via the motor assembly which includes one driving motor 64. Accordingly, the driving device 40 may be largely symmetric with respect to a center line that divides the door part 31 into and left and right portions.

In some implementations, the motor assembly 60 may include a plurality of gears, as exemplarily illustrated in FIG. 9, to adjust an output speed and/or torque of the driving motor 62.

Also, the motor assembly 60 may be configured such that the driving motor 64 and the gears are arranged vertically relative to one another along an up-down direction of the door part 31 to thereby minimize a thickness of the motor assembly 60 when mounted on the door part 31. Thus, a thickness of the recessed space required to accommodate the motor assembly 60 in the door part 31 may be minimized. That is, by spreading out the internal components of the motor assembly 60, as well as the overall driving device 40, laterally in the left/right/up/down directions, a thickness of the motor assembly 60, as well as the overall driving device 40, may be minimized in the front/rear direction. A slim profile of the driving device 40 can help maximize available storage space in the drawer part 32.

Also, the driving motor 64 of the motor assembly 60 may protrude toward the drawer part 32, relative to the rest of the motor assembly 60, to minimize a depth of the recessed space in the door part 31 and help increase insulation performance.

The driving motor 64 may provide power for elevating the elevation device 80 and may rotate in forward and reverse directions. Thus, when an elevation signal of the elevation device 80 is inputted, the driving motor 64 may rotate in forward and reverse directions as needed to raise and lower the elevation device 80. In some cases, a stop signal may be sent to the driving motor 64 based on, for example, an excessive load applied to the motor or various sensors.

The motor assembly may include a motor case 61 in which the driving motor 64 is installed and a motor cover 62 coupled to the motor case 61 to cover the driving motor 64.

A rotation shaft of the driving motor 64 may protrude from the motor case 61 in a direction opposite to the motor cover 62. The rotation shaft of the driving motor 64 is extended along a longitudinal direction of the motor assembly 60. Also, the motor assembly may further include a power transmission part that transmits power of the driving motor 64. The power transmission part may be disposed at an opposite side of the driving motor 64 with respect to the motor case 61.

In some implementations, the power transmission part may include a combination of a plurality of gears and be covered by the cover member 68 mounted on the opposite side of the driving motor 64.

The power transmission part may include a driving gear 651 connected to the shaft of the driving motor 64 passing through the motor case 61. The power transmission part may further include a first transmission gear 652 engaged with the driving gear 651 at a lower portion of the driving gear 651.

For example, the first transmission gear 652 may be a multi-stage gear. For example, the first transmission gear 652 may include a first gear 652*a* engaged with the drive gear 651 and a second gear 652*b* having a diameter less than that of the first gear 652*a*. Each of the first gear 652*a* and the second gear 652*b* may be a spur gear.

The power transmission part may further include a second transmission gear 653 engaged with the first transmission gear 652. The second transmission gear 653 may be engaged with the first transmission gear 652 at the lower portion of the first transmission gear 652. The second transmission gear 653 may include a first gear 653*a* engaged with the second gear 652*a* of the first transmission gear 652 and a second gear 653*b* having a diameter greater than that of the first gear 653*a*.

Each of the first gear 653*a* and the second gear 653*b* of the second transmission gear 653 may be a spur gear. Also, the second gear 653*b* of the second transmission gear 653 may be disposed at a location that is vertically lower than the first gear 652*a* of the first transmission gear 652. Due to this orientation of the first transmission gear 652 and the second transmission gear 653, a lateral width of the driving part 40 may be minimized.

The power transmission part may further include a third transmission gear 654 engaged with the second transmission gear 653. The third transmission gear 654 may be engaged with the second gear 653*b* at a location that is vertically lower than the second gear 653*b* of the second transmission gear 653. The third transmission gear 654 may be a spur gear. A portion of the third transmission gear 654 may be arranged to overlap with the second transmission gear 653 in the longitudinal direction.

The motor case 61 may include gear shafts for rotatably supporting the plurality of transmission gears.

The power transmission part may further include a pair of intersection gears 655 and 656 that each engage with the third transmission gear 654. The pair of intersection gears 655 and 656 may be spaced apart from each other in the horizontal (i.e., left-right) direction of the door part 31 and may be engaged with the third transmission gear 654 at a position lower than the center of rotation of the third transmission gear 654. As described further below, the intersection gears 655 and 656 can transmit the torque from the driving motor 64 to each of the screws 52 and 52*a*. In some cases, a rotational axis of the intersection gear, which extends along the longitudinal direction of the motor assembly, may be transverse to, or cross, a rotational axis of the screws 52 and 52*a*.

As seen in FIG. 10, each of the intersection gears 655 and 656 may include spur gear parts 655*a* and 656*a*, each of which may have the form of a spur gear, along with first helical gear parts 655*b* and 656*b*, each of which may have the form of a helical gear. Accordingly, each of the intersection gears 655 and 656 can be engaged with the third transmission gear 654 so as to be able to transmit the torque from the driving motor 64 to the screws 52 and 52*a*.

Rotation center lines of the intersection gears 655 and 656 may extend parallel to each other and be laterally spaced from each other on both left and right sides of the third transmission gear 654.

The power transmission unit may further include a pair of second helical gear parts 657 and 657*a* that are respectively engaged with the intersection gears 655 and 656.

As illustrated in FIG. 11, the second helical gear parts 657 and 657*a* may be engaged with the first helical gear parts 655*b* and 656*b*. The rotation center lines of the second helical gear parts 657 and 657*a* may be arranged to cross the rotation center lines of the intersection gears 655 and 656. Thus, the first and second helical gear parts 655*b* and 656*b* and the second helical gear parts 657 and 657*a* may be coupled to each other in the crossing state to transmit rotation force with respect to each other.

The rotation center lines of the intersection gears 655 and 656 may extend in the longitudinal direction, and the rotation center lines of the second helical gear parts 657 and 657*a* may extend in a generally upward direction along a vertical plane of the driving device 40. For example, the rotation center lines of the second helical gear parts 657 and 657*a* disposed on both the left and right sides may be pointed away from each other and toward the upper direction.

By using a pair of helical gears as illustrated above to transmit the power of the driving motor 64 to each of the screws, the driving device can be more compact in size, in particular with regard to its longitudinal profile. Additionally, because helical gears tend to operate more smoothly and quietly compared to, for instance, spur gears due to their gradual gear engagement, the driving of the screws may be performed more smoothly and with less noise.

The pair of screw units 50 and 50*a* may be disposed on both the left and right sides of the motor assembly 60.

The pair of screw units 50 and 50*a* may be disposed on both the left and right sides of the inside of the door unit 31. The pair of screw units 50 and 50*a* may have the same structure and shape as each other except for their mounting positions.

The power of the drive motor 64 may be transmitted from the lower portions of the screw unit 50 and 50*a*.

Here, the screw units 50 on both sides may be symmetrical to each other with respect to the motor assembly 60. Thus, the motor assembly 60 may be disposed between the screw units 50 disposed on both the sides. The screw units 50 disposed on both the sides may be gradually close to each other from upper ends to lower ends.

The screw units 50 and 50*a* may include screws 52 and 52*a* that rotate by receiving the power of the driving motor 64. The screws 52 and 52*a* may extend generally in the vertical direction from a bottom of the driving device 40 to a top of the driving device 40. In some cases, as illustrated, the screws 52 and 52*a* may be tilted such that the upper end of each of the screws 52 and 52*a* is inclined toward an outer side of the door part 31 and the lower end toward an inner side of the door part 31.

The screws 52 and 52*a* may be connected to the second helical gear parts 657 and 657*a*. The screws 52 and 52*a* may rotate together when the second helical gear parts 657 and 657*a* rotate.

For example, an insertion part may be defined in each of the second helical gear parts 657, 657*a*, and an accommodation groove into which the insertion part is accommodated may be defined in the screw 52.

Thus, the screws 52 and 52*a* may also be disposed symmetrically on both sides of the motor assembly 60 and may be inclined in the same center line as the center line of the second helical gear parts 657 and 657*a*. Thus, the screws 52 and 52*a* on the left and right sides may be arranged in a direction that is away from each other toward the upper side.

The screw units 50 and 50*a* may further include screw holders 56 and 56*a* coupled to the screws 52 and 52*a* so as to pass therethrough.

The screw holders 56 and 56*a* may move vertically along the screws 52 and 52*a* when the screws 52 and 52*a* rotate. The lever 42 may be coupled to the screw holders 56 and 56*a*. The lever 42 may rotate when the screw holders 56 and 56*a* move.

A holder through-hole 561 may be defined in a center of each of the screw holders 56 and 56*a*. The holder through-hole 561 may be defined to pass through the screw holders 56 and 56*a*, and the screws 52 and 52*a* may be inserted and mounted to pass through the holder through-hole 561. A screw thread coupled to the screw may be disposed on an inner surface of the holder through-hole 561. When the screws 52 and 52*a* rotate, the screw holders 56 and 56*a* may be movable along the screws 52 and 52*a*.

A guide hole 565 may be defined in both left and right sides of the holder through-hole 561. The guide hole 565 may receive the guide bars 53 and 54, which will be described below, and the screw holders 56 and 56*a* may move along the guide bars 53 and 54.

Each of the guide bars 53 and 54 may have a round rod shape and may be made of a metal material to stably support the screw holders 56 and 56*a*.

A bearing may be provided on an inner surface of the guide hole 565 to facilitate the movement of the screw holders 56 and 56*a*. In some cases, a sleeve-shaped lubrication member that is penetrated by the guide bars 53 and 54 may be provided in the guide hole 565. The lubrication member may be made of engineering plastic or a friction reducing material. Thus, the screw holders 56 and 56*a* may move more easily and may generate less noise. Alternatively, in some cases, the screw holders 56 and 56*a* themselves may be made of an engineering plastic material that provides less friction.

The pair of guide bars 53 and 54 may be configured to pass through the guide holes 565. Thus, the screw holders 56 and 56*a* may be stably elevated without moving horizontally. The elevation device 80 may be stably elevated even under a heavy load, and less noise may be generated.

In some cases, the screw holder 56*a* may be provided with a magnet 563. For example, the screw holder 56*a* may have a magnet mounting groove 563*a* into which the magnet is press-fitted and may have a structure in which the magnet 563 is inserted into the magnet mounting groove 563*a*.

The magnet 563 may detect a position of the screw holder 56*a*. When the screw holder 56*a* is disposed at the lowermost or uppermost end of each of the screws 52 and 52*a*, an elevation detection device 90 described below may detect the screw holder 56*a*. That is, whether the ascending or descending of the elevation device is completed may be determined by detecting the magnet 563 mounted on the screw holder 56*a*.

Also, in some cases, a structure in which a holder connector 562 is capable of being mounted may be provided on an opposite side of the rear surface of the screw holder 56*a* in which the magnet 563 is provided, i.e., on the front surface of the screw holder 56*a*.

The holder connector 562 may connect the lever 42 to the screw holders 56 and 56*a* and may be fixedly mounted on the screw holders 56 and 56*a*. That is, the holder connector 562 may be coupled to the screw holders 56 and 56*a* while passing through the lever 42. The lever 42 may include a rectangular slot 426 to prevent an interference with the holder connector 562 during the rotation of the lever 42.

Since the screw units 50 and 50*a* are disposed on both the left and right sides, extension lines of the screws 52 and 52*a* on both the left and right sides may cross each other outside the driving device 40.

The lever 42 may connect the screw holder 56 and 56*a* to the elevation device 80. Thus, both ends of the lever 42 may be rotatably coupled to the screw holder 56 and 56*a* and the elevation device 70, respectively.

The screw units 50 and 50*a* may further include a housing 51 for accommodating the screws 52 and 52*a*.

The housing 51 may define an outer appearance of the screw unit 50 and provide a space in which the screws 52 and 52*a* and the screw holder 56 and 56*a* are accommodated. The opened portion of the housing 51 may be covered by the cover member 66.

The housing 51 may be made of a metal material, which can be bent, or made of a plastic material.

The housing 51 may include a first accommodation part 511 accommodating the screws 52 and 52*a* and a second accommodation part 512 accommodating the second helical gear parts 657 and 657*a*.

The first accommodation part 511 and the second accommodation part 512 may be partitioned by the partition wall 513. The second accommodation part 512 may be disposed below the first accommodation part 511.

A portion of the intersection gears 655 and 656 may be accommodated in the second accommodation part 512. That is, the intersection gears 655 and 656 and the second helical gear parts 657 and 657*a* may be connected to each other in the second accommodation part 512.

A lower portion of each of the screws 52 and 52*a* may pass through the partition wall 513, and the second helical gear parts 657 and 657*a* may be coupled to the screws 52 and 52*a* passing through the partition wall 513.

The housing 51 may be provided with one or more guide bars 53 and 54 guiding the ascending of the screw holders 56 and 56*a*. The one or more guide bars 53 and 54 extend in parallel with the screws 52 and 52*a* while being spaced apart from the screws 52 and 52*a*.

The plurality of guide bars 53 and 54 may be provided in the housing 51 so that the screw holders 56 and 56*a* are not inclined to any one side of the left or right sides with respect to the screws 52 and 52*a*. Here, the screw 52 may be disposed between the plurality of guide bars 53 and 54.

The motor case 61 and the pair of housings 51 may be integrated with each other. A single cover member 66 may cover the motor case 61 and the pair of housings 51.

That is, the cover member 66 may be coupled to the motor case 61 to cover the power transmission part and be coupled to the pair of housings 51 to cover the screws 52 and 52*a*, the guide bars 53, and the screw holders 56 and 56*a*.

Alternatively, in some cases, the cover member 66 may include a plurality of portions that cover the power transmission part and the screw units 50 and 50*a*, respectively, and may be configured to independently open and close the respective parts.

Since the driving device 40 is in the form of a single module, the driving part 40 may be compact and be easily installed in the door part 31.

The single cover member 66 may cover the motor case 61 and the pair of housings 51 together. Thus, when the cover member 66 is separated, the user may easily access the motor case 61 and the pair of housings 51.

The screw unit 50*a* disposed at one side of the left and right screw units 50 and 50*a* may be provided with the elevation detection device 90. Since the screw units 50*a* on both the left and right sides operate simultaneously by the one motor assembly 60, the operation of the elevation device 80 may be effectively performed even if the elevation detection device 90 is provided in only one screw unit 50*a*. Thus, the elevation detection device 90 may be provided on either one of the left and right screw units 50 and 50*a*.

The elevation detection device 90 may be configured to determine whether the elevation of the elevation device 80 is completed. Here, it may be determined whether the elevation device 80 is completely elevated based on the operation of the driving device 40.

The elevation detection device 90 may be mounted on the cover member 66 and vertically disposed along the screw unit 50*a*.

The elevation detection device 90 may include a support plate 91, detection sensors 92 and 93 mounted on the support plate 91, and a case 95 accommodating the support plate 91.

In more detail, the support plate 91 may have a length greater than that of at least the screw 52*a* or a stroke of the screw holder 56*a*. The support plate 91 may be disposed on a first area 511 on which the screw holder 56*a* moves and may be disposed along a path along which the magnet 563 moves. Both ends of the support plate 91 may be fixedly mounted on the partition wall 513 and caps 57 of the upper ends of the screw units 50 and 50*a*.

The support plate 91 may have a plate shape, and a pair of detection sensors 92 and 93 may be mounted on both sides of the support plate 91. The support plate 91 may be made of a plate-like material that is fixedly mounted on detection positions of the detection sensors 92 and 93. Also, the support plate 91 may be a substrate on which the detection sensors 92 and 93 are mounted.

A sensor for detecting the magnet 563 may be used as each of the detection sensors 92 and 93. The detection sensor may be a hall sensor that normally detects the position of the magnet. Alternatively, as necessary, other sensors or devices for detecting the magnet 563 may be provided instead of the hall sensor.

Also, other configurations or devices that are capable of detecting a specific position of the screw holder 56*a* may be used instead of the magnet 563 and the hall sensor.

One of the detection sensors 92 and 93 may mounted at a position corresponding to the position of the magnet 563 when the elevation device 80 completely ascends, and another one may be mounted at a position corresponding to the position of the magnet 563 when the elevation device 80 completely descends. Thus, when any one detection sensor 92 or 93 of the pair of detection sensors 92 and 93 recognizes the magnet, it is determined that the elevation device 80 completely ascends or descends.

The support plate 91 on which the detection sensors 92 and 93 are mounted may be accommodated in the case 95. The case 95 may be a portion of the cover member 66. The case 95 may be recessed from the inner surface of the cover member 66 and provide a space in which the support plate 91 is accommodated. The case 95 may be separately provided and mounted on the cover member 66.

The case 95 may define a space for accommodating the support plate 91. The case 95 may further include a connector mounting part 951 provided with a connector 94. The connector mounting part 951 may protrude to accommodate the connector 94 therein.

The connector 94 may be connected to an electric wire extending from the pair of the detection sensors 92 and 93 and be connected to an electric wire 941 from the outside. That is, it may be possible to connect the electric wire to the connector 94 from the outside without separating the support plate 91 or the detection sensors 92 and 93.

When the support plate 91 is the substrate on which the detection sensors 92 and 93 are mounted, the connector 94 may be disposed on the support plate 91 corresponding to the connector mounting part 951.

Figure 12:
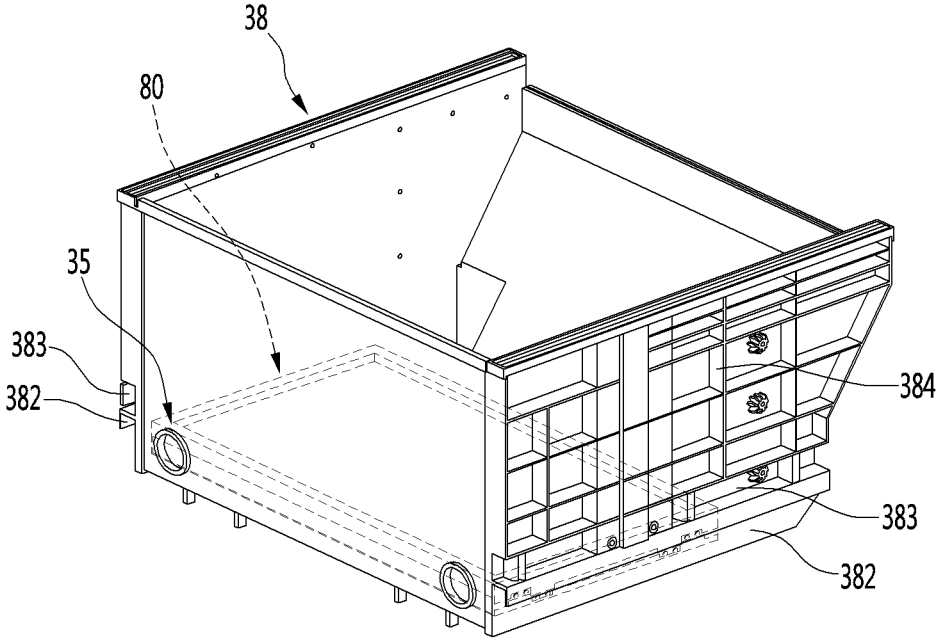
FIG. 12 is a perspective view of the drawer part.

FIG. 12 is a perspective view of the drawer part. Also, FIG. 13 is an exploded perspective view of the drawer part.

Figure 13:
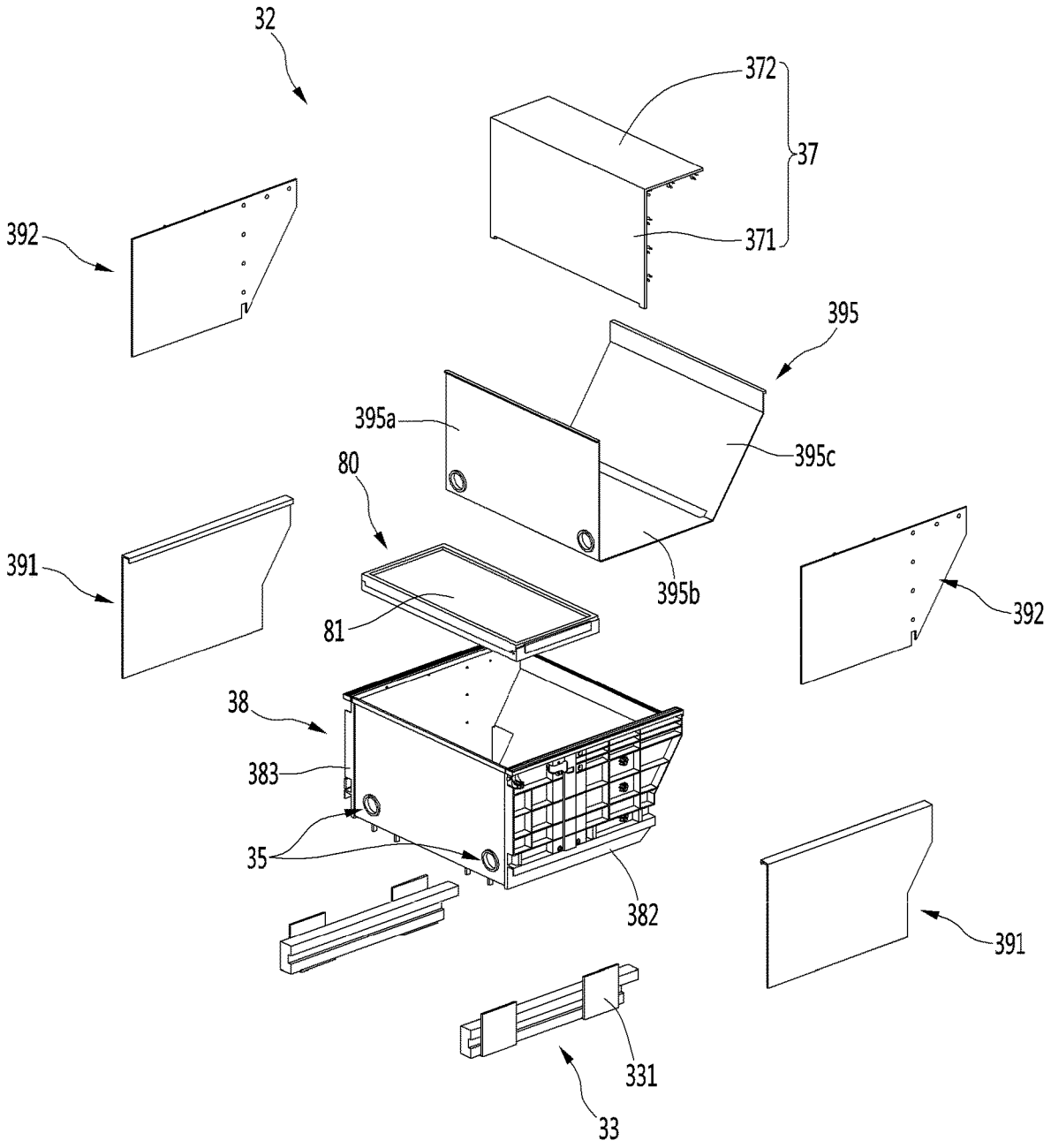
FIG. 13 is an exploded perspective view of the drawer part.

Referring to FIGS. 3, 13, and 13, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In detail, the drawer body 38 may be injection-molded by using a plastic material and define an entire shape of the drawer part 32. The drawer body 38 may have a basket shape having an opened top surface to define a food storage chamber therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the door part 31 may be integrally coupled to be inserted and withdrawn.

The door frame 316 and the drawer part 32 may be coupled to each other by a separate coupling member or a coupling structure between the door frame 316 and the drawer unit 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the door 30 may be inserted and withdrawn.

The door 30 may not be automatically inserted and withdrawn. That is, the user may push or pull the door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated.

The draw-out rail 33 may be a rail that extends in multistage. The draw-out rail 33 may have one end fixed to the storage chamber inside the cabinet 10 and the other end fixed to the rail mounting part 382 to more stably realize insertion and the withdrawal of the door 30.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, structures such as the door frame 316 and the draw-out rail 33, which are mounted on both the sides of the drawer body 38, may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device 40 and the elevation device 80.

Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may include a front surface part 395*a*, a bottom surface part 395*b*, and a rear surface part 395*c*, which have sizes correspond to the front surface, the bottom surface, and the rear surface of the inside of the drawer body 38.

The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* of the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal.

Thus, the storage chamber within the drawer part 32 may have a metal texture on the whole, and the foods accommodated in the drawer part 32 may be more uniformly cooled and thus stored at a low temperature in the more uniform region. In addition, excellent cooling performance and storage performance that is also visually appealing may be provided to the user as a result.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation device 80 is disposed, may be exposed in the drawer body 38, and the rear space S2 may be covered by the drawer cover 37.

The elevation device 80 may be disposed in the drawer body 38. The elevation device 80 may be connected to the driving device 40 and may be vertically movable. The left and right sides of the elevation device 80 may be elevated uniformly.

A drawer opening 35 may be defined in the lower part of the front surface of the drawer part 32 for coupling the elevation device 80 to the driving device 40.

The elevation device 80 may be provided as a scissors type so that the elevation device is folded in a descending state and unfolded in an ascending state. Thus, the container or food seated on the upper surface may be elevated.

Also, the elevation device 80 may be provided with a support plate 81, and the support plate 81 may provide a seating surface on which the container 36 or food is seated.

The height of the drawer opening 35 may be lower than the upper end of the elevation device 80, i.e., the upper surface of the support plate 81. Thus, the drawer opening 35 may be prevented from being seen from the inside of the drawer part 32 in any state in the state in which the elevation device 80 is mounted.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Figure 14:
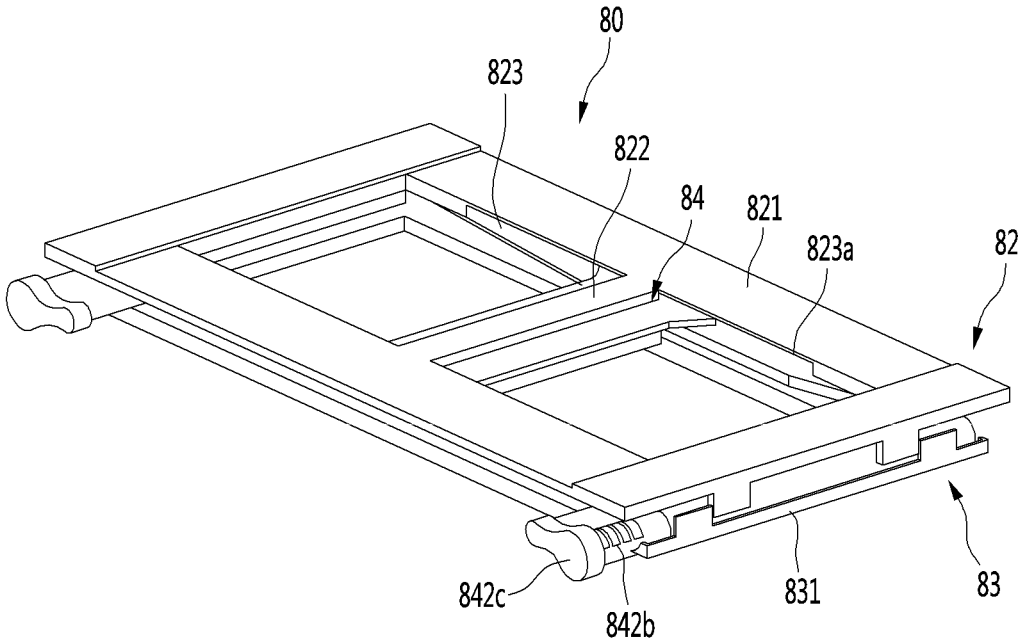
FIG. 14 is a perspective view of the elevation device according to an implementation.
Figure 15:
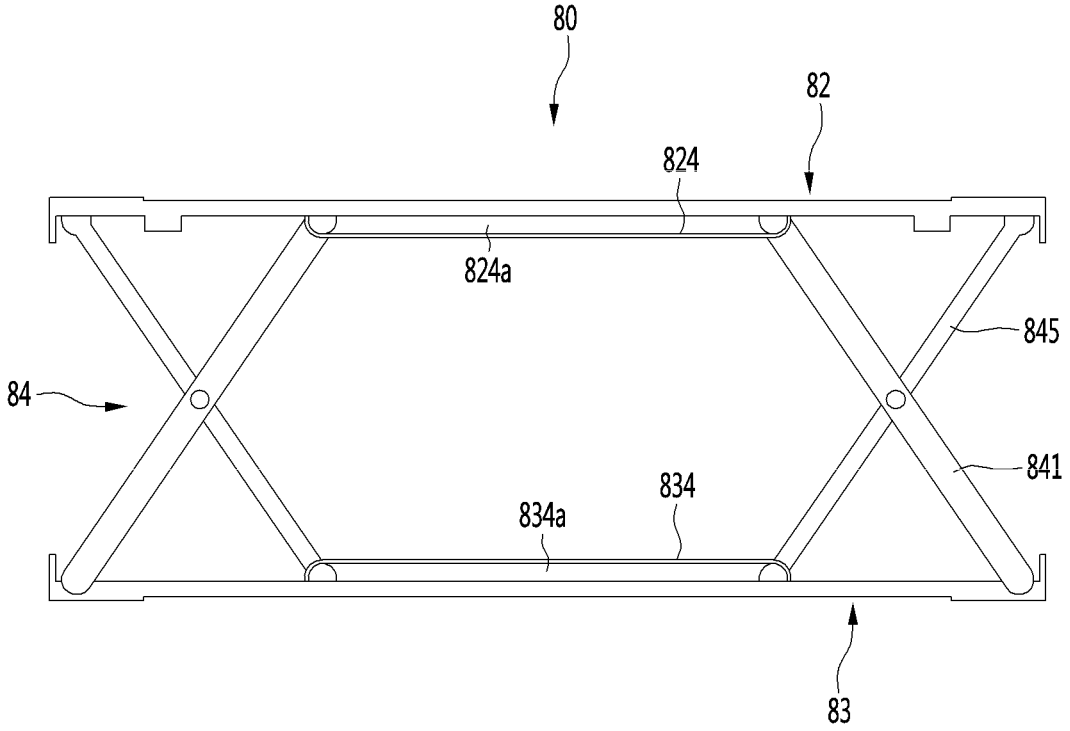
FIG. 15 is a view illustrating a state in which an upper frame of the elevation device ascends.

FIG. 14 is a perspective view of the elevation device according to an implementation. Also, FIG. 15 is a view illustrating a state in which an upper frame of the elevation device ascends. Also, FIG. 16 is a view illustrating a state in which the lever is connected to the elevation device.

Figure 16:
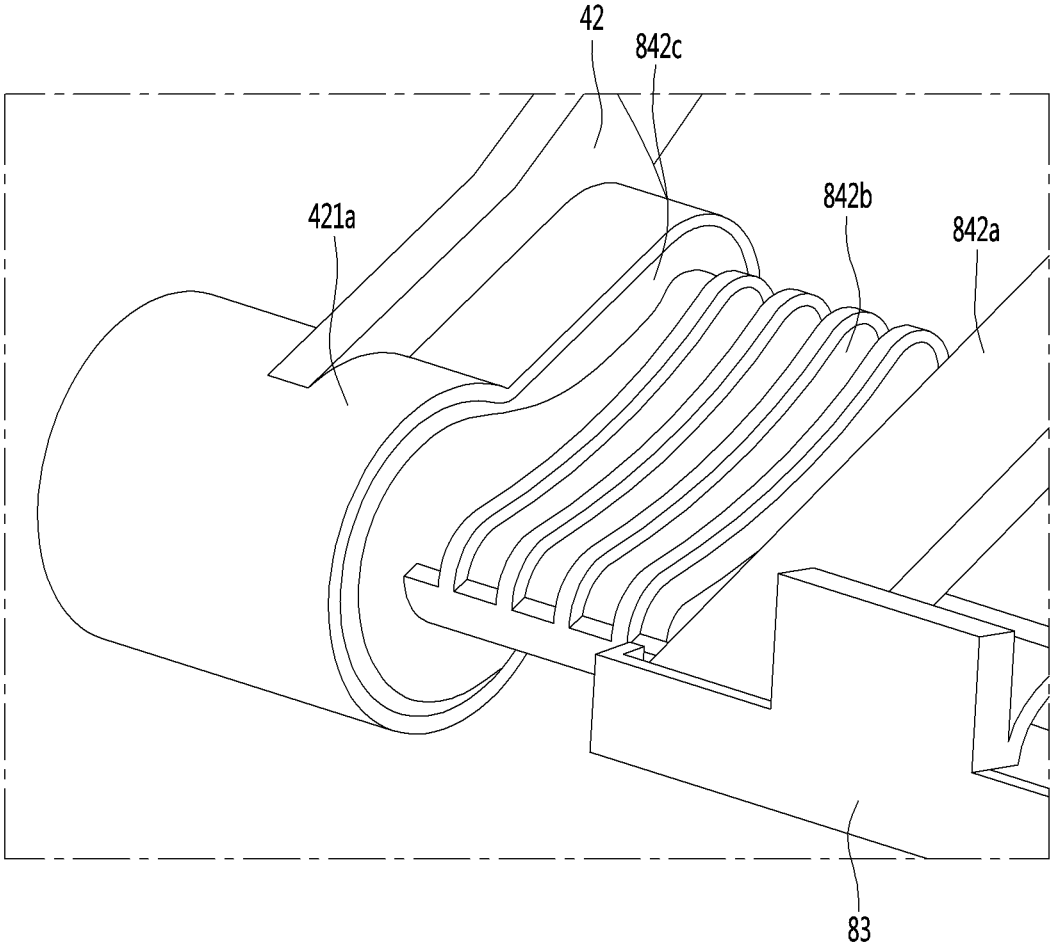
FIG. 16 is a view illustrating a state in which a lever is connected to the elevation device.

Referring to FIGS. 14 to 16, the elevation device 80 may be provided on the bottom surface of the inner side of the drawer part 32 and may be detachably installed on the inside of the drawer part 32.

Also, the elevation device 80 may include an upper frame 82, a lower frame 83, and a scissors assembly 84 disposed between the upper frame 82 and the lower frame 83.

In detail, the upper frame 82 may have a square frame shape corresponding to the size of the inner front space S1 of the drawer part 32 and to mount the support plate 81 on the top surface thereof.

The upper frame 82 of the elevation device 80 may move upward and downward and substantially supports food or the container 36 together with the support plate 81.

The upper frame 82 may generally defines a frame part 821 which defines a circumferential shape of the upper frame 82 and a partition part 822 for partitioning the space inside the frame portion 821 into left and right sides.

Since the frame part 821 and the partition part 822 define an outer frame and support the support plate 81, high strength may be required, and thus, the frame part 821 and the partition part 822 may be made of a metal and may have shape in which both ends are bent to increase the strength and prevent deformation.

Also, a slide guide 824 may be disposed on a bottom surface of the frame part 821 to accommodate the end of the scissors assembly 84 and guide the movement of the scissors assembly 84.

The scissors assemblies 84 may be disposed in both the spaces 823 and 823*a* of the partition 822, respectively.

The slide guide 824 may define a long hole 824*a* through which the scissors assembly 84 pass. The scissors assembly 84 may move along the slide guide 824.

The lower frame 83 may have the same or similar structure as the upper frame 82 except for a direction.

The lower frame 83 may include a frame part and a partition part. Also, the slide guide 834 which guides movement of the scissors assembly 84 by accommodating an end of the scissors assembly 84 may be disposed on a top surface of the lower frame 83.

The slide guide 834 may define a long hole 834*a* through which the scissors assembly 84 pass. The scissors assembly 84 may move along the slide guide 834.

The scissors assemblies 84 may be provided on both right and left sides. The scissors assemblies 84 on both sides may receive power from one driving motors 64 to operate and thus may be elevated at the same height.

Thus, the scissors assembly 84 may be effectively elevated by the pair of the scissors assemblies 84 which independently apply the forces to both sides even when the heavy load is supported by the scissors assembly 84. Here, the upper frame 82, i.e., the support plate 81 may be elevated in a horizontal state through the scissor assembly 84.

The scissors assembly 84 may include a first scissors frame 841 in the form of a square frame and a second scissors frame 845 in the form of a rectangular frame rotatably connected to the first scissors frame 841 have.

The second scissors frame 845 may have a horizontal width less than that of the first scissors frame 841. Thus, the second scissors frame 845 may be connected to the first scissors frame 841 while being disposed within an area defined by the first scissors frame 841.

The first scissors frame 841 may include a lower shaft (see reference numeral 841*a* of FIG. 21) and an upper shaft (see reference numeral 841*b* of FIG. 23) extending in the horizontal direction.

The lower shaft (see reference numeral 841*a* of FIG. 23) may rotatably supported by the lower frame 83, and the upper shaft (see reference numeral 841*b* of FIG. 23) may be arranged to pass through the sliding guide 824 of the upper frame 82.

The first scissors frame 841 may be connected to a first rod (see reference numeral 841*a* of FIG. 23) and an upper shaft (see reference numeral 841*b* of FIG. 23) extending in the vertical direction.

The second scissors frame 845 may include a lower shaft 851*a* and an upper shaft, which extend in the horizontal direction and a first rod 852*a* and a second rod 852*b*, which extend in the vertical direction.

The first rod 842*a* of the first scissors frame 84 may have an extension part 842*b* protruding to be connected to the lever 42 and a coupling part 842*c* provided on an end of the extension part 842*b*.

The lever 42 may include an accommodation part 421*a* accommodating the coupling part 842*c* so as to be coupled to the coupling part 842*c*.

An end of the coupling part 842*c* may have a non-circular shape. Thus, the lever 42 may be prevented from being loosened with the coupling part 842*c* when the lever 42 rotates while the coupling part 842*c* is accommodated in the accommodation part 421*a*.

The coupling part 842*c* and the extension part 842*b* may extend to pass through the drawer opening 35, and the extension part 842*b* may be disposed on the drawer opening 35. The elevation device 80 inside the drawer part 32 may be connected to the driving device 40 outside the drawer part 32 by the extension part 842*b* and the coupling part 842*c*.

Hereinafter, a state in which the door 30 of the refrigerator 1 is inserted and withdrawn and is elevated according to an implementation will be described in more detail with reference to the accompanying drawings.

Figure 17:
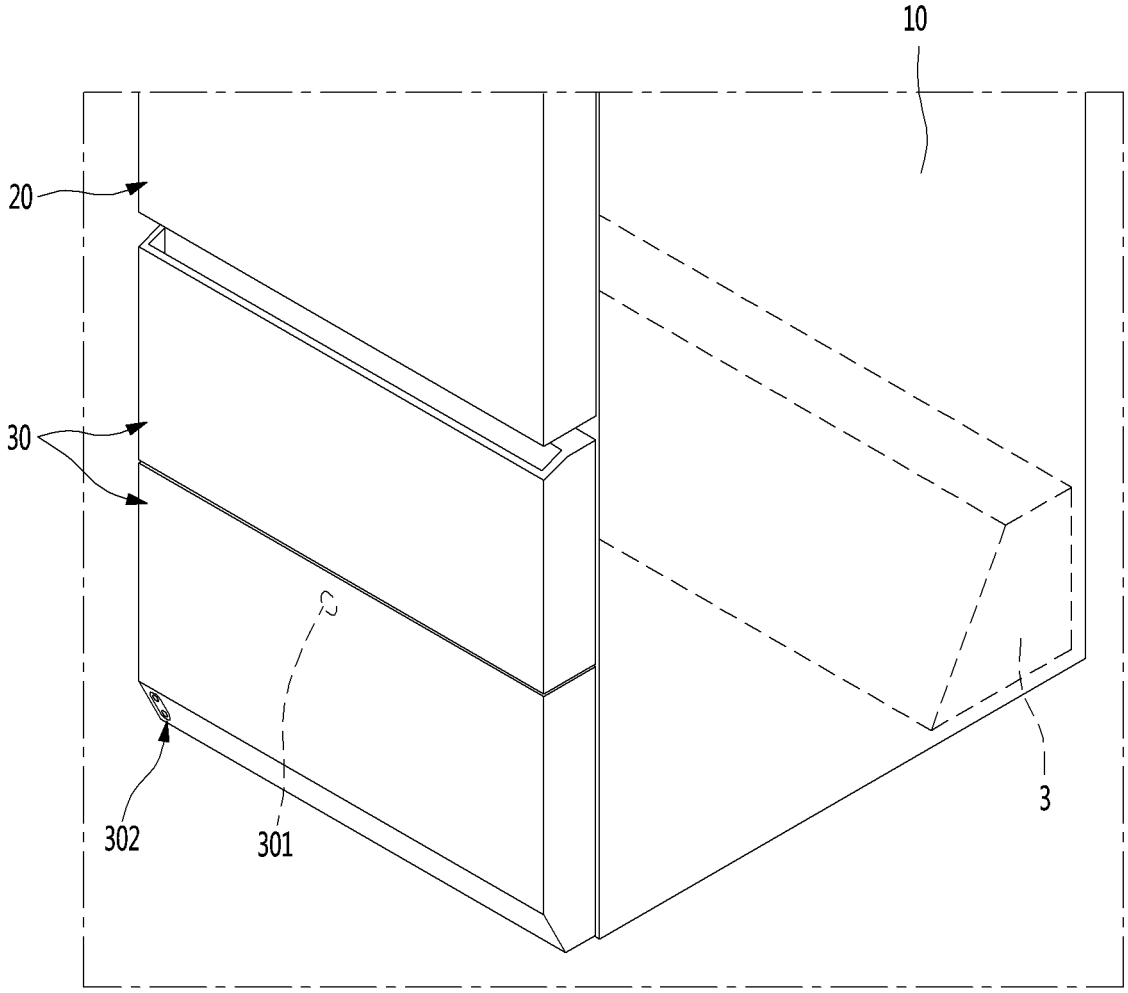
FIG. 17 is a perspective view illustrating a state in which the lower drawer door is closed.

FIG. 17 is a perspective view illustrating a state in which the lower drawer door is closed.

Referring to FIG. 17, in the state in which the food is stored, the refrigerator 1 may be maintained in a state in which all of the rotation door 20 and the door 30 are closed. In this state, the user may withdraw the door 30 to accommodate the food.

The door 30 may be provided in plurality in a vertical direction and be withdrawn to be opened by the user's manipulation.

Here, the user's manipulation may be performed by touching the manipulation part 301 disposed on the front surface of the rotation door 20 or the door 30. Alternatively, an opening command may be inputted on the manipulation device 302 provided on the lower end of the door 30.

Also, the manipulation part 301 and the manipulation device 302 may individually manipulate the insertion and withdrawal of the door 30 and the elevation of the elevation device 80. Alternatively, the user may hold a handle of the door 30 to open the drawer door 30.

Hereinafter, although the lower drawer door 30*b* of the doors 30, which are disposed in the vertical direction, is opened and elevated as an example, all of the upper and lower doors 30 may be inserted and withdrawn and elevated in the same manner.

Figure 18:
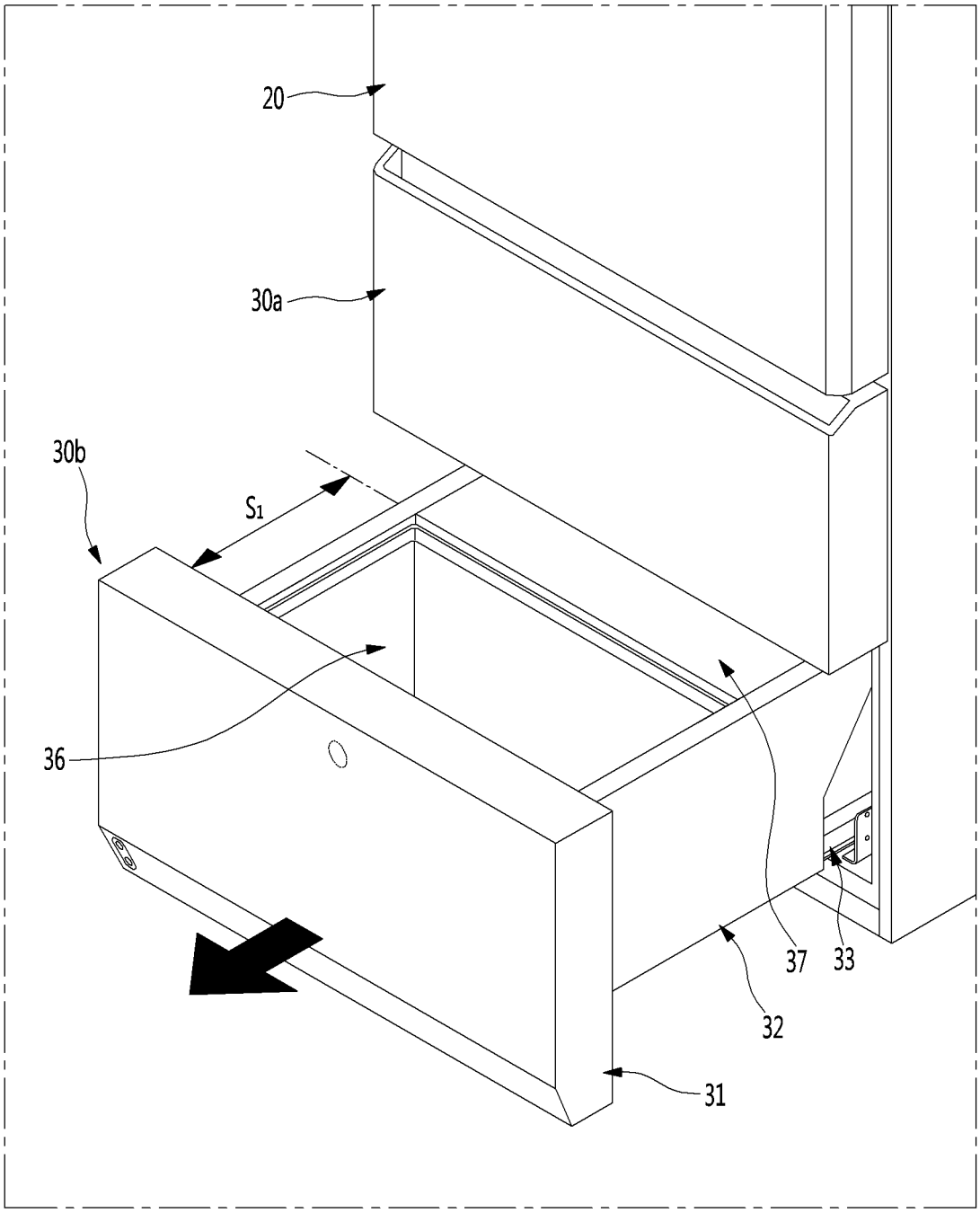
FIG. 18 is a perspective view illustrating a state in which the lower drawer door is completely opened.
Figure 19:
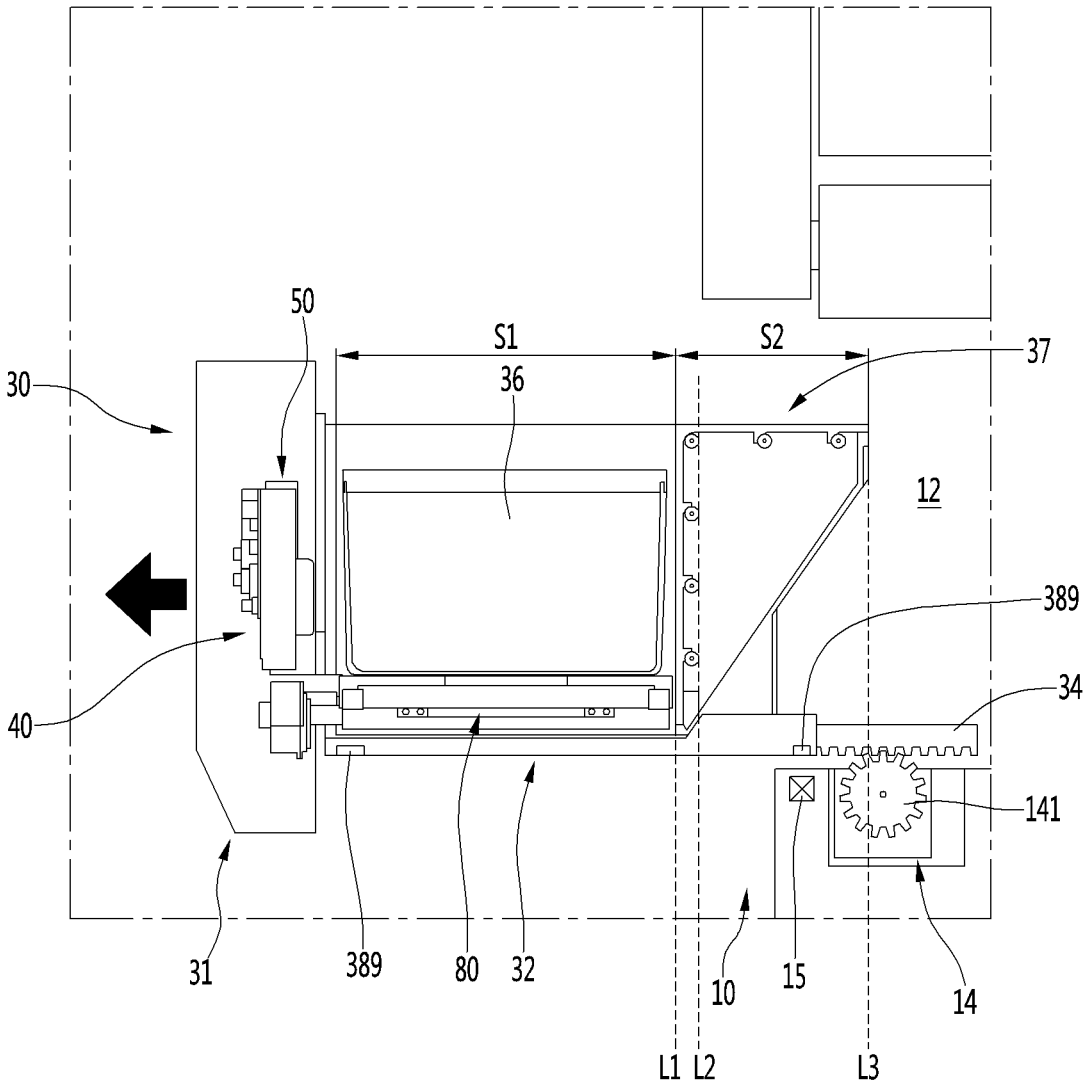
FIG. 19 is a cross-sectional view of the drawer door in a state in which a container of the lower drawer door completely descends.
Figure 20:
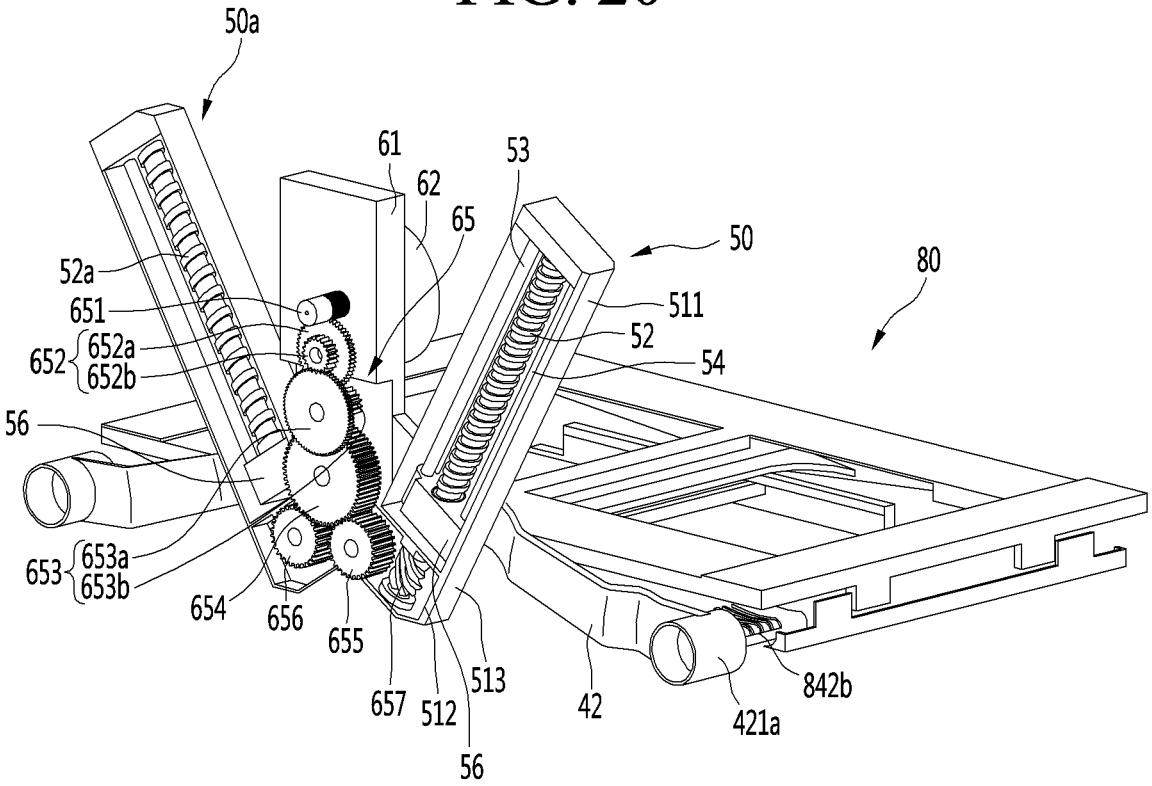
FIG. 20 is a perspective view illustrating states of the driving device and the elevation device in the state of FIG. 19.
Figure 21:
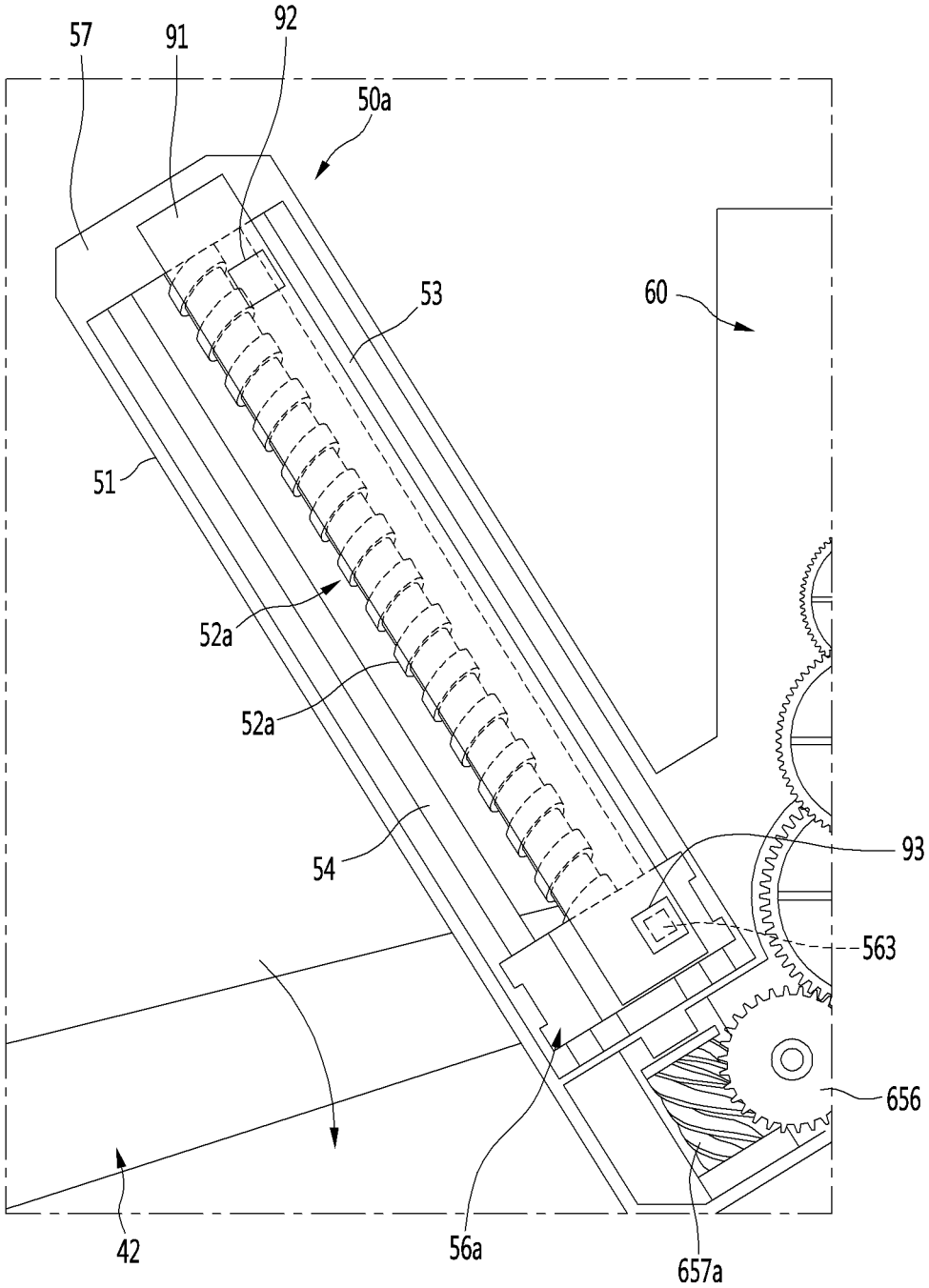
FIG. 21 is a view illustrating an elevation detection state in the state of FIG. 19.

FIG. 18 is a perspective view illustrating a state in which the lower drawer door is completely opened. Also, FIG. 19 is a cross-sectional view illustrating a state of the drawer door in a state in which the basket of the drawer door completely descends. Also, FIG. 20 is a perspective view illustrating states of the driving device and the elevation device in the state of FIG. 19. Also, FIG. 21 is a view illustrating an elevation detection state in the state of FIG. 19.

Referring to FIGS. 18 to 21, the user may manipulate the lower drawer door 30*b* to withdraw the lower drawer door 30*b* forward. The lower drawer door 30*b* may be withdrawn while the draw-out rail 33 extends.

The lower drawer door 30*b* may be configured to be inserted and withdrawn by the driving of the draw-out motor 14, not by a method of directly pulling the lower drawer door 30*b* by the user.

The draw-out rack 34 provided on the bottom surface of the lower drawer door 30*b* may be coupled to the pinion gear 141 rotating when the draw-out motor 14 provided in the cabinet 10 is driven. Thus, the lower drawer door 30*b* may be inserted and withdrawn according to the driving of the draw-out motor 14.

The draw-out distance of the lower drawer door 30*b* may correspond to a distance at which the front space S1 within the drawer part 32 is completely exposed to the outside. Thus, in this state, when the elevation device 80 is elevated, the container or the food may not interfere with the doors 20 and 30 or the cabinet 10 disposed above it.

Here, the draw-out distance of the lower drawer door 30*b* may be determined by a draw-out detection device 15 disposed on the cabinet 10 and/or the lower drawer door 30*b*.

The draw-out detection device 15 may be provided as a detection sensor that detects a magnet 389 to detect a state in which the lower drawer door 30*b* is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the lower drawer door 30*b* is closed and a position of the magnet 389 when the lower drawer door 30*b* is completely withdrawn. Thus, the drawn-out state of the lower drawer door 30*b* may be determined by the draw-out detection device 15.

Also, as necessary, a switch may be provided at each of positions at which the lower drawer door 30*b* is completely inserted and withdrawn to detect the drawn-out state of the lower drawer door 30*b*. In addition, the drawn-out state of the lower drawer door 30*b* may be detected by counting the rotation number of draw-out motor 14 or measuring a distance between the rear surface of the door part 31 and the front end of the cabinet 10.

In the state in which the lower drawer door 30*b* is completely withdrawn, the driving motor 64 may be driven to elevate the elevation device 80. The elevation device 80 may be driven in an even situation in which the lower drawer door 30*b* is sufficiently withdrawn to secure safe elevation of the food or container 36 seated on the elevation device 80.

That is, in the state in which the lower drawer door 30*b* is withdrawn to completely expose the front space S1 to the outside, the elevation device 80 may operate to prevent the container 36 or the stored food seated on the elevation device 80 from interfering with the doors 20 and 30 or the cabinet 10.

Referring to the drawn-out state of the lower drawer door 30*b*, the front space S1 is to be completely withdrawn to the outside of the lower storage chamber 12 in the state in which the lower drawer door 30*b* is withdrawn for the elevation.

Particularly, the rear end L1 of the front space S1 is to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Also, when the elevation device 80 is completely withdrawn to be driven, the entire drawer part 32 may not be completely withdrawn but withdrawn up to only a position for avoiding interference when the elevation device 80 is elevated as illustrated in FIG. 19. Here, at least a portion of the rear space S2 of the drawer part 32 may be disposed inside the lower storage chamber 12. That is, the rear end L3 of the drawer portion 32 may be disposed at least inside the lower storage chamber 12.

Thus, even when the weight of the stored object is added to the weight of the lower drawer door 30*b* itself including the driving device 40 and the elevation device 80, the deflection or damage of the draw-out rail 33 or the lower drawer door 30*b* itself may not occur to secure the reliable draw-out operation.

The ascending of the elevation device 80 may start in a state in which the lower drawer door 30*b* is completely withdrawn. Also, to secure the user's safety and prevent the food from being damaged, the ascending of the elevation device 80 may start after a set time elapses after the lower drawer door 30*b* is completely withdrawn.

After the lower drawer door 30*b* is completely withdrawn, the user may manipulate the manipulation part 301 to input the ascending of the elevation device 80. That is, the manipulation part 301 may be manipulated to withdraw the door 30, and the manipulation part 301 may be manipulated again to drive the elevation device 80.

Also, in the state in which the lower drawer door 30*b* is manually inserted and withdrawn, the manipulation part 301 may be manipulated to drive the elevation device 80.

As illustrated in FIG. 19, the driving device 40 and the elevation device 80 may not operate until the lower drawer door 30*b* is completely withdrawn, and the elevation device 80 may be maintained in the lowest state.

In a state before the elevation device 80 ascends, the lever 42 and the screw holder may be disposed at the lowest position, and the elevation detection device 90 may detect this position to determine that the present state is a state in which the elevation device 80 completely descends.

In detail, the screw holder 56*a* may be disposed at the lowest position when the elevation device 80 completely descends. The magnet 563 provided in the screw holder 56*a* may be disposed at a position corresponding to the detection sensor 93 disposed below the pair of the detection sensors 92 and 93. The detection sensor 93 disposed below detects the magnet 563 to determine that the elevation device 80 completely descends.

When it is determined that the elevation device 80 completely descends by the elevation detection sensor 90, the driving device 40 may start an operation when the user's manipulation occurs or when the lower drawer door 30*b* is completely withdrawn.

If it is determined that the elevation device 80 does not completely descend, the elevation detection device 90 may output an abnormal signal, and thus, the driving device 40 may not operate.

Figure 22:
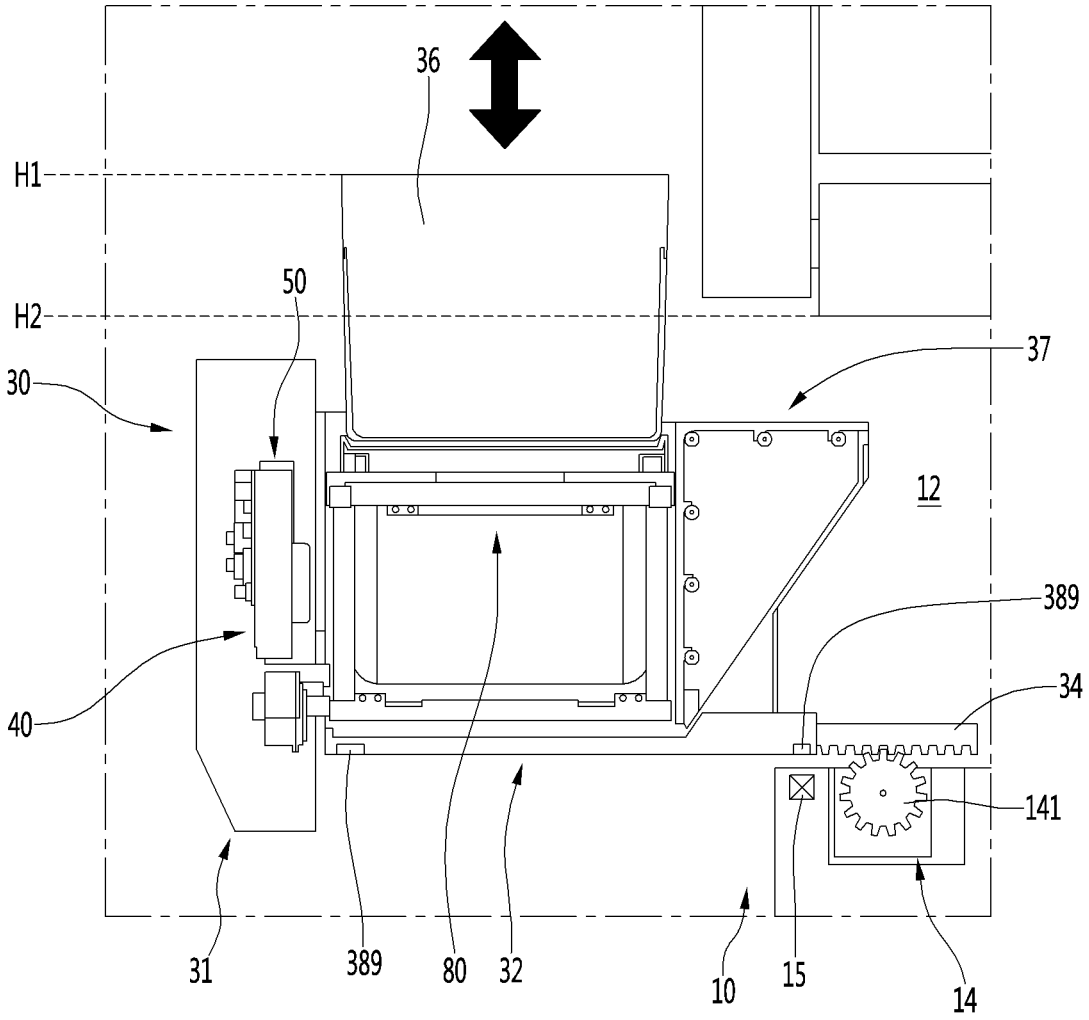
FIG. 22 is a cross-sectional view of the drawer door in a state in which the container of the lower drawer door completely ascends.
Figure 23:
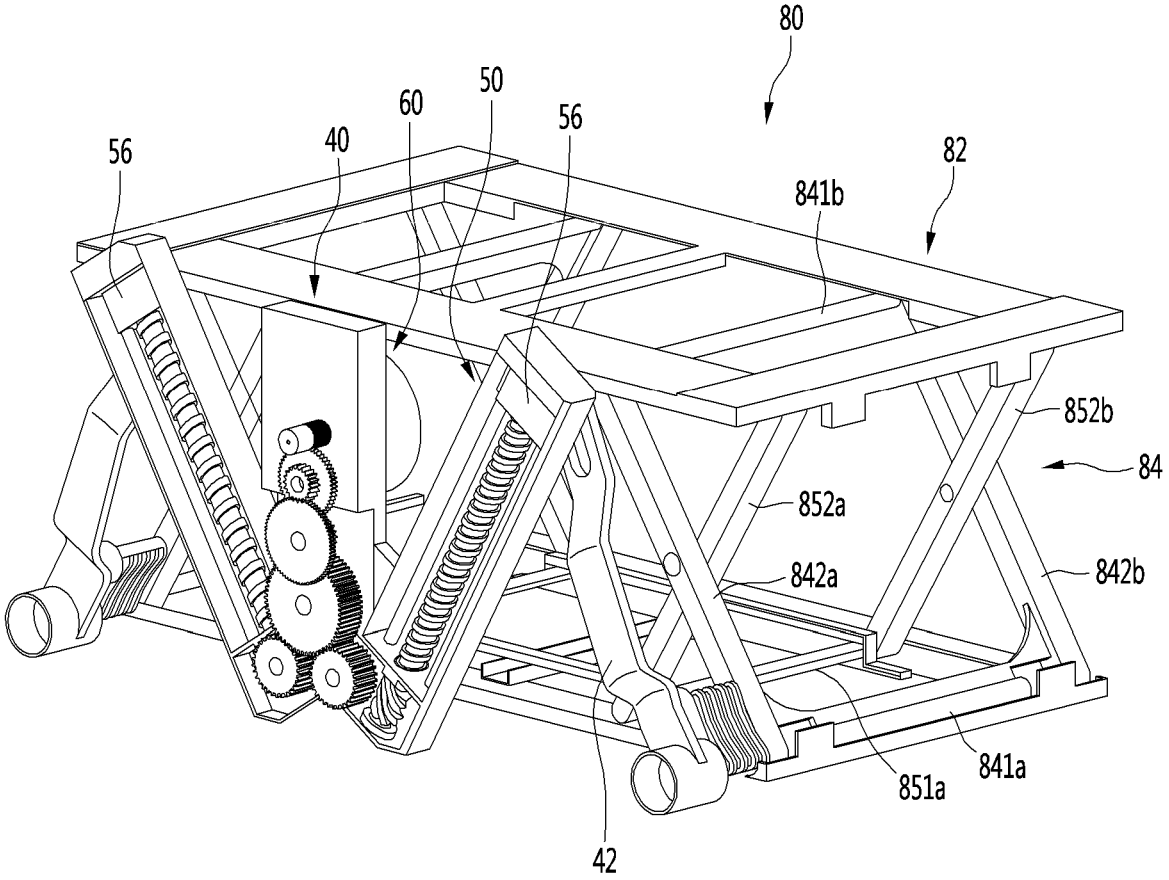
FIG. 23 is a perspective view illustrating states of the driving device and the elevation device in the state of FIG. 22.

FIG. 22 is a cross-sectional view of the drawer door in a state in which the container of the lower drawer door completely ascends. Also, FIG. 23 is a perspective view illustrating states of the driving device and the elevation device in the state of FIG. 22. Also, FIG. 24 is a view illustrating an elevation detection state in the state of FIG. 22.

Figure 24:
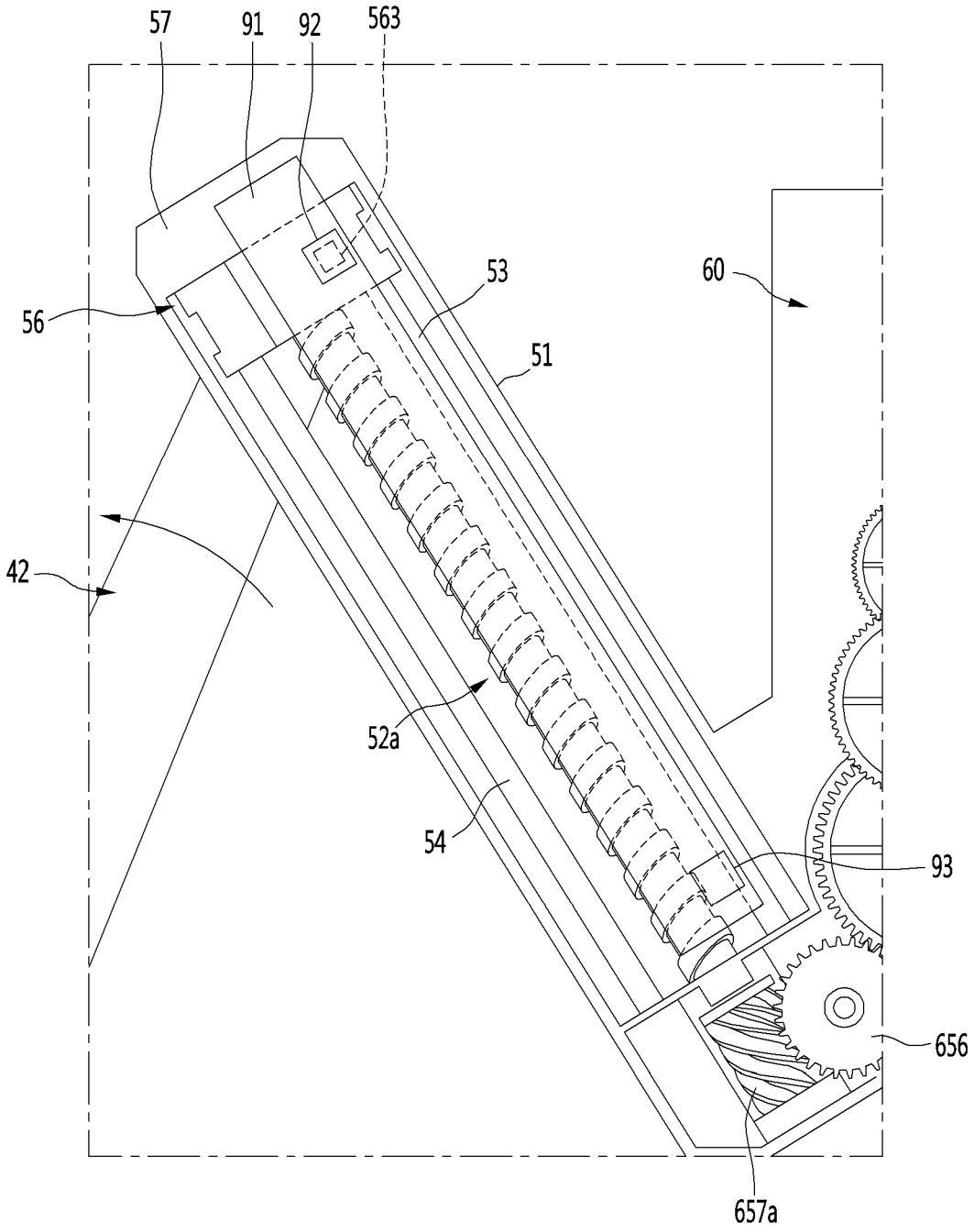
FIG. 24 is a view illustrating an elevation detection state in the state of FIG. 22.

Referring to FIGS. 22 to 24, in the state in which the lower drawer door 30*b* is withdrawn, when an operation signal of the driving device 40 is inputted, the driving device 40 may operate, and the state as illustrated in FIG. 22 may be obtained by elevating the elevation device 80.

In this implementation, the ascending of the elevation device 80 may mean that the upper frame 82 ascends by the scissors assembly 84, and the descending of the elevation device 80 may mean that the upper frame 82 descends by the scissors assembly 84.

The driving device 40 may be connected to the elevation device 80 so that the power is transmitted to the elevation device 80. The power may be transmitted to the elevation device 80 together with the operation of the driving device 40, and the elevation device 80 may start to ascend.

In detail, when the driving motor 64 rotates in the normal or reverse direction by the ascending/descending signal of the elevation device 80, the operation of the driving device 40 may start.

In details of the ascending operation of the elevation device 80, the driving gear 651 may rotate by the operation of the driving motor 64. The rotational force of the driving motor may be transmitted to the intersection gears 655 and 656 through the first to third transmission gears 652, 653, and 654 by the rotation of the driving gear 651.

The second helical gear parts 657 and 657*a* connected to the intersection gears 665 and 656 may rotate by the intersection gears 655 and 656 to change the power transmission direction. The screws 52 and 52*a* connected to the second helical gear parts 657 and 657*a* may rotate.

Since the same rotation force is transmitted to the screws 52 and 50*a* on both sides, the screw holders 56 and 56*a* may ascend by the same height.

As the screw holders 56 and 56*a* ascends, the lever 42 connected to the screw holders 56 and 56*a* may also rotate. The height of the lever 42 increases while the lever 42 connected to the screw holders 56 and 56*a* rotates, and the height of the first rod 842*a* of the first scissors frame 84 connected to the lever 42 may increase by the increase in height of the lever 42.

The scissors assembly 84 may be unfolded by the increase in height of the first rod 842*a* of the first scissors frame 84.

As a result, the scissors assembly 84 may be unfolded so that the upper frame 82 ascends, and the container 36 or the food placed on the support plate 81 may ascend, and finally, the elevation device 80 may ascend to its maximum height as illustrated in FIG. 22.

The elevation device 80 may continuously ascend and then be stopped when ascending to a sufficient height to facilitate the access to the food or container 36 seated on the elevation device 80 as illustrated in FIG. 22. In this state, the user may easily lift the food or container 36 without overtaxing the waist.

The lever 42 and the screw holder may be disposed at the highest position, and the elevation detection device 90 may detect the highest position to determine that the present state is a state in which the elevation device 80 completely ascends.

In detail, the screw holder 56*a* may be disposed at the highest position when the elevation device 80 completely ascends. Also, the magnet 563 provided in the screw holder 56*a* may be disposed at a position corresponding to the detection sensor 92 disposed above the pair of the detection sensors 92 and 93. The detection sensor 93 disposed below may detect the magnet 563 to determine that the elevation device 80 completely ascends to be in a state of completely ascending.

If it is determined that the elevation device 80 completely ascends by the elevation device 90, the driving motor 64 may be stopped. In this state, although the elevation device 80 is disposed inside the drawer part 32, the food or container seated on the elevation device 80 may be disposed at a position higher than the opened top surface of the drawer part 32. Thus, the user may easily access the food or container 36.

Particularly, it is not necessary to allow the waist excessively for lifting the container 36, so that it is possible to perform safer and more convenient operation.

In details of the maximally ascending state of the elevation device 80, the elevation device 80 may be disposed at least at a lower position than the upper end of the drawer part 32.

In the elevation device 80, when viewed with respect to the container 36 in the state in which the container 36 is seated, the upper end H1 of the container 36 may ascend to a position higher than the upper end H2 of the lower storage chamber 12. Here, the height of the container 36 may reach a height suitable for the user to reach the container 36 without stretching his/her waist.

That is, the elevation device 80 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the elevation device 80 completely descends, the state shown in FIG. 19 may be obtained. The completion of the descending of the elevation device 80 may be also performed by the elevation detection sensor 90. When the magnet is detected by the detection sensor 93 disposed below, the elevation device 80 may determine that the descending is completed, and the driving device 40 may be stopped.

Also, after the driving of the elevation motor 64 is stopped, the lower drawer door 30*b* may be inserted. Here, the lower drawer door 30*b* may be closed by the user's manipulation or by the driving of the draw-out motor 14.

When the lower drawer door 30*b* is completely closed, the state of FIG. 17 may be obtained.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 25:
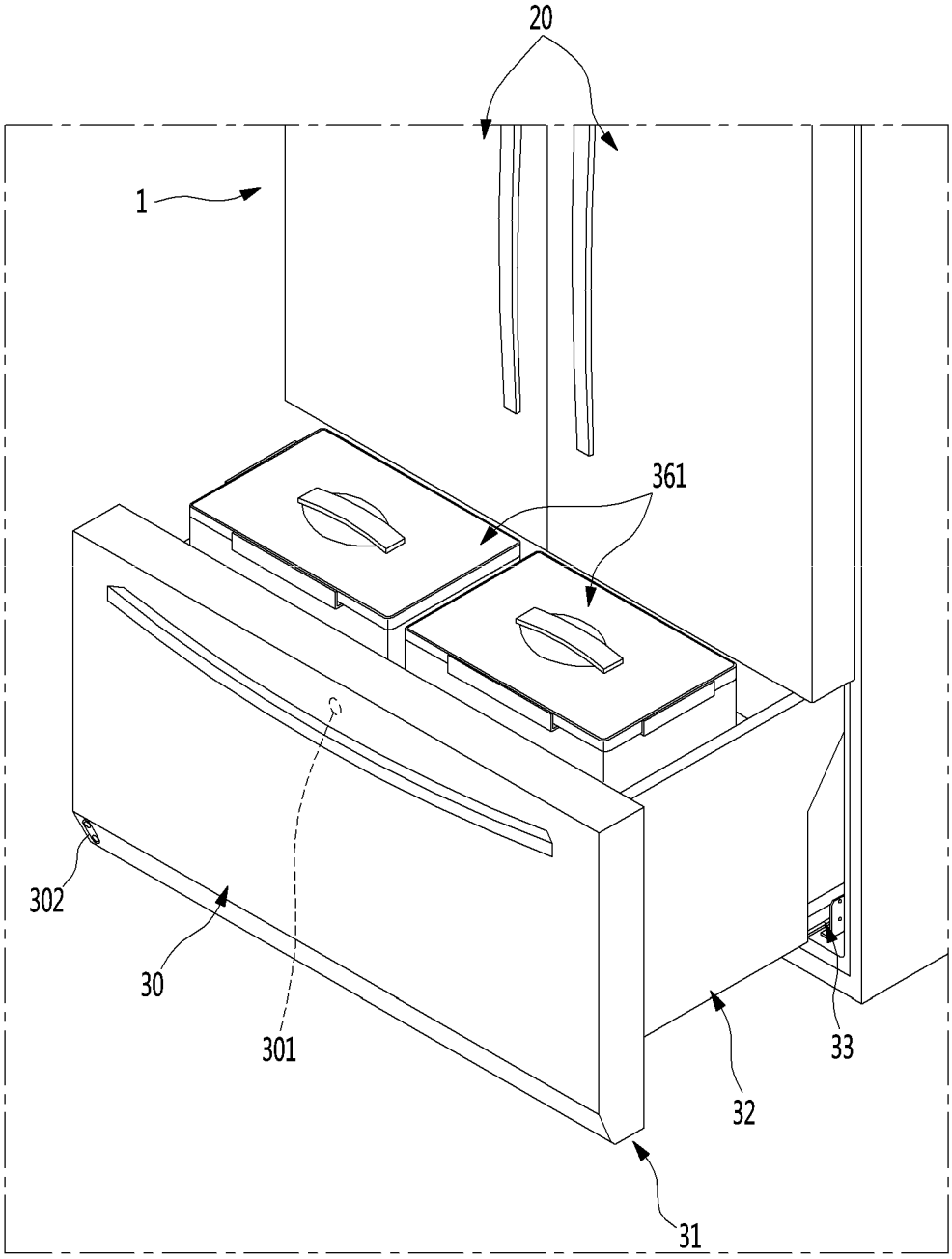
FIG. 25 is a perspective view of a refrigerator according to another implementation.

FIG. 25 is a perspective view of a refrigerator according to another implementation.

Referring to FIG. 25, a refrigerator 1 according to another implementation may include a cabinet 10 having a storage chamber that is vertically partitioned and a door opening and closing the storage chamber.

The door may include a rotation door 20 which is provided in an upper portion of a front surface of the cabinet 10 to open and close an upper storage chamber and a door 30 disposed in a lower portion of the front surface of the cabinet 10 to open and close a lower storage chamber.

The door 30 may be inserted and withdrawn forward and backward in the above implementation, and the container and the food inside the drawer part 32 may be vertically elevated by the operation of the driving device 40 and the elevation device 80 inside the door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the door part 31, and the driving part 40 may be installed inside the door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by the driving device.

A plurality of containers 361 may be provided in the elevation device 80. The container 361 may be a sealed container such as a kimchi box, and a plurality of the containers 361 may be seated on the elevation device 80. The container 361 may be elevated together with the elevation device 80 when the elevation device 80 is elevated.

Thus, in the state in which the container 361 ascends, at least a portion of the drawer part 32 may protrude, and thus, the user may more easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Figure 26:
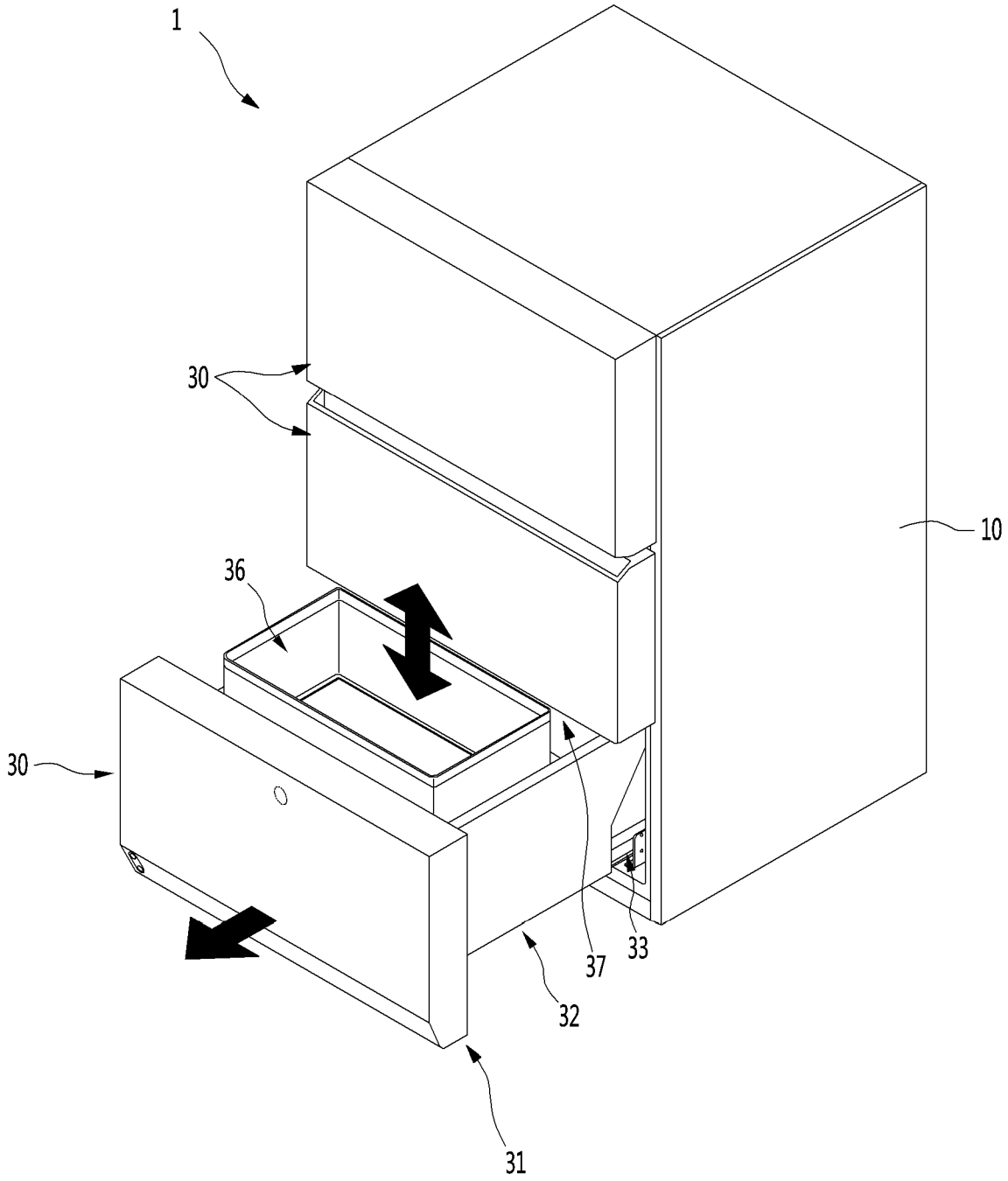
FIG. 26 is a perspective view of a refrigerator according to another implementation.

FIG. 26 is a perspective view of a refrigerator according to another implementation.

Referring to FIG. 26, a refrigerator 1 according to another implementation includes a cabinet 10 defining a storage chamber therein and a door opening and closing an opened front surface of the cabinet 10, which define an outer appearance of the refrigerator 1.

The door may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the door part 31, and the elevation part 80 may be provided inside the drawer part 32. Also, the driving device 40 and the elevation device 80 may be connected to each other when the door part 31 and the drawer part 32 are coupled to each other.

Also, the elevation device 80 may be disposed in the front space S1 of the total storage chamber of the drawer part 32.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 26, all of the drawer doors disposed at the upper side may also be elevated by the elevation device 80 that is provided inside.

If a height of each of the drawer doors 30 disposed at the upper side is sufficiently high, only the drawer door 30 disposed at the lowermost position or the elevation device 80 of the of drawer doors 30 disposed relatively downward may be elevated.

Figure 27:
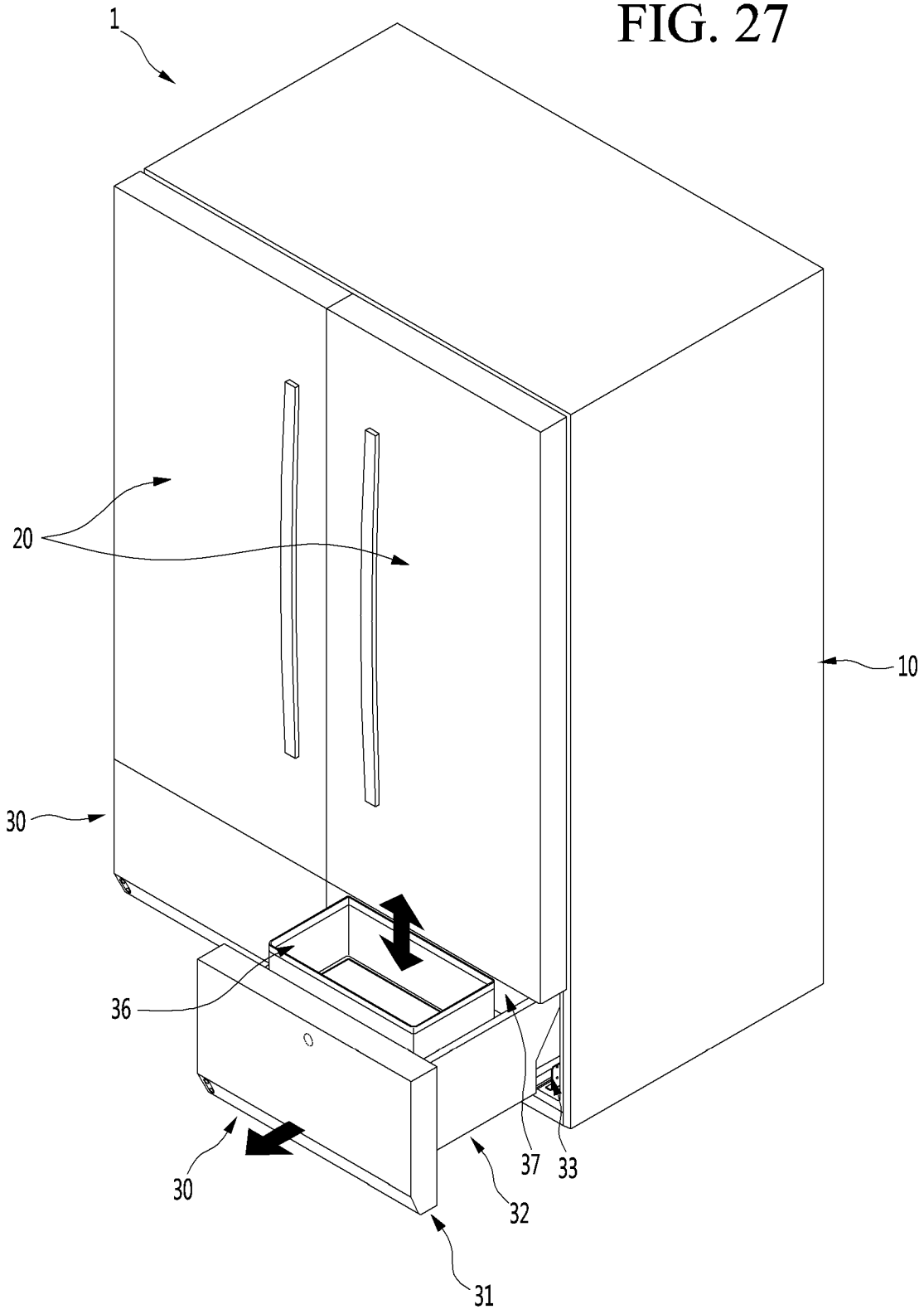
FIG. 27 is a perspective view of a refrigerator according to another implementation.

FIG. 27 is a perspective view of a refrigerator according to another implementation.

As illustrated in the drawings, a refrigerator 1 according to another implementation includes a cabinet 10 defining a storage chamber therein and a door opening and closing an opened front surface of the cabinet 10, which define an outer appearance of the refrigerator 1.

The inside of the cabinet 10 may be divided into an upper space and a lower space. If necessary, the upper and lower storage chambers may be divided again into left and right spaces.

The door may include a rotation door 20 which is provided in an upper portion of the cabinet 10 to open and close the upper storage chamber and a drawer door 30 disposed in a lower portion of the cabinet 10 to open and close the lower storage chamber.

In some implementations, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the door part 31, and the elevation part 80 may be provided inside the drawer part 32. Also, the driving device 40 and the elevation device 80 may be connected to each other when the door part 31 and the drawer part 32 are coupled to each other. Also, the elevation device 80 may be disposed in the front space S1 of the total storage chamber of the drawer part 32.

The drawer door 30 may have the same structure as the drawer door according to the foregoing implementation. Thus, the drawer door 30 may be inserted and withdrawn by user's manipulation. In the drawer door 30 is withdrawn, the elevation device 80 may ascend so that a user more easily accesses a food or container within the drawer door 30.

The following effects may be expected in the refrigerator according to the proposed implementations of the present disclosure.

The refrigerator according to the implementation, the portion of the storage chamber within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the elevation within the drawer door may ascend up to a convenient position by driving the driving device to prevent the user from being injured and significantly improve the convenience in use.

Also, the driving device that includes electric devices for providing power may be provided inside the door part, and the elevation device for the elevation may be provided inside the drawer part so that the driving device and the elevation device are not exposed to the outside to improve the outer appearance.

Particularly, the driving device that includes the electric devices may be disposed inside the door part, and it may be possible to prevent the user from accessing the door to prevent the occurrence of the safety accident.

Also, the driving part may be disposed in the door part to minimize the storage capacity loss of the drawer part. Also, the elevation device or the structure that is compactly folded and accommodated in the descending state may be provided to secure the storage capacity in the refrigerator.

Also, the driving device may be provided in the door to reduce noise during the use.

Particularly, the screw holder for rotating the lever to which the substantially large load is applied may be allowed to move along the guide bar, thereby preventing the movement of the screw holder and significantly reducing the noise caused thereby.

In some cases, the guide bar may be disposed on each of both the sides of the screw to allow the screw holder to move more stably so that the power transmission for elevation may be more stably performed while minimizing power loss at the same time.

In some cases, a lubricant member may be provided in the screw holder through which the screw passes to contact the guide bar, thereby reducing the friction with the screw and providing for smoother movement of the screw holder.

Also, the screw and the rotation shaft of the gear of the motor assembly may be disposed to cross each other and be configured to be coupled to each other by the helical gear structure. Thus, the noise of the driving device may be kept at a minimum even when the food having the large load is accommodated.

Also, when the service is required in the case of the abnormal situation or the inspection, the door part and the drawer part may be separated from each other to perform the service through the door part in which the electric device is installed, thereby improving serviceability.

Also, the drive device may be provided with the screw unit on both sides and provide the power to both sides of the elevation device to help smoothly elevate the food or container having a high load.

Also, since both screw units are operated using the driving force of one motor, the horizontal elevation of the elevation device, without unwanted deflection or tilting, may be achieved without requiring additional electronic or structural elements.

In some cases, the driving device may disposed inside the door, and the elevation device may be disposed inside the drawer. Thus, the driving device and the elevation device may prevented from being exposed to the outside during the use, and the safety and the outer appearance may be further improved.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage chamber;

a drawer door comprising a door part configured to open and close the storage chamber and a drawer part that is configured to be inserted into and withdrawn out of the storage chamber and defines a storage space;

a rail assembly that slidably couples the drawer door to the cabinet;

a driving device disposed at the door part and configured to provide a driving force; and an elevation device disposed at the drawer part, the elevation device being coupled to the driving device to vertically elevate at least a portion of the drawer part, wherein the driving device comprises:

a motor assembly, a pair of screw units, each of the pair of screw units being disposed on opposite sides of the motor assembly and configured to be actuated by the motor assembly at the same time as each other, and a pair of levers, each of the pair of levers being coupled to and configured to be rotated by a corresponding one of the pair of screw units, the pair of levers being coupled to and configured to elevate the elevation device, and wherein each of the screw units comprises:

a housing, a screw disposed in the housing and configured to be rotated by the motor assembly, a screw holder that receives the screw and has a screw thread engaged with the screw, the screw holder being configured to move along the screw based on a rotation of the screw, and a guide bar disposed parallel to the screw inside the housing, the guide bar passing through the screw holder and being configured to guide the movement of the screw holder.

2. The refrigerator according to claim 1, wherein the guide bar comprises a pair of guide bars disposed on opposite sides of the screw.

3. The refrigerator according to claim 1, wherein the guide bar is made of a metal material.

4. The refrigerator according to claim 1, wherein the screw holder defines a guide hole through which the guide bar passes.

5. The refrigerator according to claim 4, wherein the screw holder includes a lubrication portion at an inner surface of the guide hole that contacts the guide bar.

6. The refrigerator according to claim 1, wherein the driving device comprises a cover portion that covers the motor assembly and the housings of the pair of screw units.

7. The refrigerator according to claim 1, wherein the pair of screw units are oriented symmetrical to each other with respect to the motor assembly, and wherein a distance between the pair of screw units increases toward an upper side of the motor assembly.

8. The refrigerator according to claim 7, wherein the motor assembly comprises:

a motor disposed at the upper side of the motor assembly; and a plurality of gears rotatably connected to a rotation shaft of the motor, wherein the plurality of gears are arranged in a vertical direction toward a lower side of the pair of screw units.

9. The refrigerator according to claim 8, wherein a rotation shaft of the screw and the rotation shaft of the motor are transverse to each other.

10. The refrigerator according to claim 9, wherein a vertically lowermost one of the plurality of gears is connected to a lower end of the screw through a helical gear coupling.

11. The refrigerator according to claim 9, wherein the plurality of gears comprise:

a driving gear fixed to the rotation shaft of the motor;

an intersection gear rotatably coupled to the screw; and one or more transmission gears that rotatably couple the driving gear to the intersection gear, wherein the intersection gear comprises:

a spur gear part having a spur gear shape and coupled to one of the one or more transmission gears, and a first helical gear part that is coupled to a second helical gear part disposed on the lower end of the screw.

12. The refrigerator according to claim 1, wherein the door part comprises:

an outer plate that defines an outer appearance of the drawer door;

a door liner that is spaced apart from the outer plate and defines a rear surface of the door part; and an insulation material disposed between the outer plate and the door liner, wherein the door liner defines a recess part in which the driving device is accommodated.

13. The refrigerator according to claim 12, wherein the door part further comprises a door cover that is disposed on the rear surface of the door part and that covers the driving device.

14. The refrigerator according to claim 12, wherein the drawer part is mounted on the door part, and wherein a front surface of the drawer part covers the driving device.

15. The refrigerator according to claim 1, wherein an accommodation part is provided in a rotation shaft of the lever, and wherein a coupling part that is detachably coupled to the accommodation part is disposed on the elevation device.

16. The refrigerator according to claim 15, further comprising a door cover disposed on a rear surface of the door part and configured to cover the driving device, wherein a cover opening is defined in the door cover at a position corresponding to the accommodation part, and wherein a drawer opening is defined in a front surface of the drawer part at a position corresponding to the coupling part.

17. The refrigerator according to claim 1, wherein the driving device includes one or more sensors that are configured to sense a position of the screw holder along the screw, the screw holder including a magnet that is configured to be sensed by the one or more sensors.

18. A refrigerator comprising:

a cabinet that defines a storage chamber;

a drawer door comprising a door part configured to open and close the storage chamber and a drawer part that is configured to be inserted into and withdrawn out of the storage chamber and defines a storage space;

a rail assembly that slidably couples the drawer door to the cabinet;

a driving device disposed at the door part and configured to provide a driving force; and an elevation device disposed at the drawer part, the elevation device being coupled to the driving device to vertically elevate at least a portion of the drawer part, wherein the driving device comprises:

a motor assembly having a motor and a plurality of gears configured to be rotated by the motor, each of the plurality of gears being configured to rotate about respective gear axes that are parallel to a rotation shaft of the motor, a pair of screw units, each of the pair of screw units being disposed on opposite sides of the motor assembly and configured to be actuated by the motor assembly at the same time as each other, and a pair of levers, each of the pair of levers being coupled to and configured to be rotated by a corresponding one of the pair of screw units, the pair of levers being coupled to and configured to elevate the elevation device, and wherein each of the screw units comprises:

a screw configured to be rotated by the motor assembly along a screw axis that is transverse to the gear axes, and a screw holder that receives the screw and has a screw thread engaged with the screw, the screw holder being configured to move along the screw based on a rotation of the screw, and wherein the plurality of gears of the motor assembly includes a pair of intersection gears that are orthogonally coupled to respective lower ends of the screws to thereby transmit a driving torque of the motor to the pair of screw units.

19. The refrigerator according to claim 18, wherein the pair of intersection gears include helical gears that are orthogonally coupled to corresponding helical gears that drive the screws.

20. The refrigerator according to claim 19, wherein the driving device includes one or more sensors that are configured to sense a position of the screw holder along the screw, the screw holder including a magnet that is configured to be sensed by the one or more sensors.

* * * * *